US009392833B2

(12) United States Patent
Witcher

(10) Patent No.: US 9,392,833 B2
(45) **Date of Patent: *Jul. 19, 2016**

(54) PROTECTIVE HELMET

(71) Applicant: Michcar Partners, LLC, Bingham Farms, MI (US)

(72) Inventor: David L. Witcher, Oak Island, NC (US)

(73) Assignee: MICHCAR PARTNERS, LLC, Bingham Farms, MI (US)

( * ) Notice: Subject to any disclaimer, the term of this patent is extended or adjusted under 35 U.S.C. 154(b) by 182 days.

This patent is subject to a terminal disclaimer.

(21) Appl. No.: 14/152,490

(22) Filed: Jan. 10, 2014

(65) Prior Publication Data

US 2014/0123371 A1 May 8, 2014

Related U.S. Application Data

(63) Continuation-in-part of application No. 13/721,186, filed on Dec. 20, 2012.

(60) Provisional application No. 61/631,549, filed on Jan. 6, 2012.

(51) Int. Cl.
*A42B 3/12* (2006.01)

(52) U.S. Cl.
CPC ..... *A42B 3/121* (2013.01)

(58) Field of Classification Search
CPC ..... A42B 3/04; A42B 3/06; A42B 3/0486; A42B 3/063; A42B 3/064; A42B 3/065; A42B 3/10; A42B 3/12; A42B 3/121; A42B 3/124; A42B 3/125; A42B 3/128
USPC ..... 2/410–414
See application file for complete search history.

(56) References Cited

U.S. PATENT DOCUMENTS 3,039,109 A * 6/1962 Simpson ..... A42B 3/121 2/413
3,872,511 A * 3/1975 Nichols ..... A42B 3/121 2/413

(Continued)

FOREIGN PATENT DOCUMENTS

CN 101227842 A 7/2008
CN 101707885 A 5/2010

(Continued)

OTHER PUBLICATIONS

International Search Report mailed Apr. 26, 2013 (PCT/US2012/071243).

(Continued)

*Primary Examiner* — Gloria Hale
(74) *Attorney, Agent, or Firm* — Dickinson Wright PLLC

(57) ABSTRACT

A protective helmet includes an outer shell and a controlled air dissipation (CAD) assembly installed within the outer shell. The CAD assembly includes an inner shell liner releasably mounted to the outer shell, a primary bellows unit disposed between an outer surface of the inner shell liner and the inside surface of the outer shell, and a secondary bellows unit disposed between an inner surface of the inner shell liner and the head of a person wearing the protective helmet. The primary bellows unit and the secondary bellows unit are thermally bonded to respective outer and inner surfaces of the inner shell liner.

28 Claims, 28 Drawing Sheets

(56) References Cited

U.S. PATENT DOCUMENTS

| | | | | |
|---|---|---|---|---|
| 3,999,220 | A * | 12/1976 | Keltner | A42B 3/065 2/23 |
| 4,354,284 | A | 10/1982 | Gooding | |
| 4,586,200 | A * | 5/1986 | Poon | A42B 3/122 2/413 |
| 5,129,107 | A * | 7/1992 | Lorenzo | A42B 1/203 2/413 |
| 5,204,998 | A * | 4/1993 | Liu | A42B 3/121 2/411 |
| 5,324,460 | A | 6/1994 | Briggs | |
| 6,073,271 | A | 6/2000 | Alexander et al. | |
| 6,591,428 | B2 | 7/2003 | Halstead et al. | |
| 7,299,505 | B2 | 11/2007 | Dennis et al. | |
| 7,676,854 | B2 | 3/2010 | Berger et al. | |
| 8,844,066 | B1 * | 9/2014 | Whitcomb | A42B 3/121 2/413 |
| 2006/0059606 | A1 * | 3/2006 | Ferrara | A01N 25/18 2/412 |
| 2007/0190293 | A1 * | 8/2007 | Ferrara | B29C 45/0053 428/166 |
| 2013/0000017 | A1 | 1/2013 | Szalkowski et al. | |
| 2013/0014313 | A1 | 1/2013 | Erb et al. | |
| 2013/0152286 | A1 * | 6/2013 | Cormier | A41D 13/0156 2/459 |
| 2013/0174331 | A1 * | 7/2013 | Witcher | A42B 3/121 2/413 |
| 2014/0123371 | A1 * | 5/2014 | Witcher | A42B 3/121 2/413 |

FOREIGN PATENT DOCUMENTS

| | | |
|---|---|---|
| EP | 0222029 A1 | 5/1987 |
| EP | 0222029 B1 | 5/1987 |

OTHER PUBLICATIONS

Search Report dated Nov. 15, 2015 from corresponding Chinese Patent Application Serial No. 201280071208.1.

* cited by examiner

PROTECTIVE HELMET

CROSS-REFERENCE TO RELATED APPLICATIONS

This application is a continuation-in-part of U.S. application Ser. No. 13/721,186 filed Dec. 20, 2012, now U.S. Pat. No. 9,113,672, which claims priority to and the benefit of U.S. Provisional Application No. 61/631,549 filed on Jan. 6, 2012. The entire disclosure of each of the above-noted applications is incorporated herein by reference.

FIELD

The present disclosure relates generally to a protective helmet and, more particularly, to a protective helmet comprised of an outer shell and a controlled air dissipation assembly that can be installed within the outer shell.

BACKGROUND

This section provides background information related to the present disclosure which is not necessarily prior art.

Protective helmets are used in a variety of sporting and racing activities, in addition to military duty, to assist in protecting the wearer's head from impact related injuries. Such protective helmets are most commonly used in sporting activities such as, for example and without limitation, football, hockey, lacrosse, cycling and baseball. Likewise, protective helmets are also used in both on-road and off-road racing activities such as, for example and without limitation, stock car and open-wheel racing, drag-racing, motorcycle racing, moto-cross racing and go-cart racing.

A primary function of a protective helmet is to protect the wearer from head injuries associated with high impact forces that may be sustained during the above-noted sporting and racing activities. Conventional protective helmets consist of a rigid outer shell and an impact damping or cushioning assembly disposed between the outer shell and the wearer's head. Many known impact damping assemblies used in protective helmets utilize a compressible material to absorb and dissipate the impact force. Typically, such compressible materials have included pressurized air, viscous gel-like mediums, foam or a combination thereof.

While such conventional protective helmets perform satisfactorily for their intended purpose, recent awareness regarding the detrimental long-term effects that head impacts may have on athletes, particularly football and hockey players, has led to a need for continued development of improved impact damping technology. Accordingly, there is a recognized need in the art to design and develop alternative technologies that advance the protection afforded to those wearing a protective helmet.

SUMMARY

This section provides a general summary of the disclosure, and is not a comprehensive disclosure of its full scope or all of its features.

In accordance with one aspect of the present disclosure, a protective helmet is disclosed which incorporates an energy dissipation system for dissipating the energy associated with an impact force applied to the protective helmet and embodying a unique and non-obvious dual-stage air dissipation technology.

In accordance with a related aspect of the present disclosure, the protective helmet includes an outer shell and a controlled air dissipation ("CAD") assembly installed within the outer shell and which utilizes the dual-stage air dissipation technology.

In accordance with these and other aspect, features and objects, the present disclosure relates to a protective helmet having the CAD assembly removably installed in the interior cavity of the outer shell. The CAD assembly includes a primary or outer bellows unit, a secondary or inner bellows unit, and an inner shell liner disposed between the primary and secondary bellows units. The primary bellows unit is secured in a sealed air-tight manner to a first or outer surface of the inner shell liner. The primary bellows unit includes a plurality of primary bellows chambers which can be interconnected by primary air bridge channels to facilitate the transfer of air between adjacent primary bellows chambers. The primary bellows chambers are defined between the outer surface of the inner shell liner and a series of interconnected first stage air-filled pad sections. The first stage pad sections are adapted to engage, or be located in close proximity to, an inner surface of the outer shell. A primary air charge hole may extend through each of the first stage pad sections to permit ambient air to be in fluid communication with the corresponding primary bellows chamber. The secondary bellows unit is also secured in a sealed air-tight manner to a second or inner surface of the inner shell liner. The secondary bellows unit includes a plurality of secondary bellows chambers which can be interconnected by secondary air bridge channels to facilitate the transfer of air between adjacent secondary bellow chambers. The secondary bellow chambers are defined between the inner surface of the inner shell liner and a series of interconnected second stage air-filled pad sections. The second stage pad sections are adapted to engage, or be in close proximity to, the head of a person wearing the protective helmet. A secondary air charge hole may extend through each of the second stage pad sections to permit ambient air to be in fluid communication with the corresponding secondary bellows chamber. Air transfer holes may extend through the inner shell liner to facilitate the transfer of air between corresponding aligned pairs of primary and secondary bellows chambers.

In accordance with one exemplary embodiment of the CAD assembly, the primary bellows chambers and the secondary bellows chambers associated with the primary and secondary bellows units are configured in a substantially mirror-image arrangement such that each primary bellows chamber is in fluid communication with a similarly configured secondary bellows chamber via the air transfer hole formed through the inner shell liner.

In accordance with another exemplary embodiment of the CAD assembly, the inner shell liner is generally a helmet-shaped component and includes front and rear mounting flanges for releasably mounting the CAD assembly to the outer shell of the protective helmet. In addition, baffle projections may be formed within the primary and secondary bellows chambers to facilitate directional flow of air therein during an air transfer event caused by resilient deflection of the first stage pad sections and/or the second stage pad sections in response to an impact force being imparted on the outer shell of the protective helmet.

In accordance with another exemplary embodiment of the CAD system, the primary bellows unit may include a plurality of interconnected primary bellows chambers configured and arranged to define at least one primary crown bellows chamber, at least one primary front bellows chamber, at least one primary rear bellows chamber, a plurality of primary side bellows chambers, and a pair of primary ear bellows chambers. The at least one primary crown bellows chamber is associated with a first stage crown pad section that is generally aligned with a crown region of the outer shell. The at least one primary front bellows chamber is associated with a first stage front pad section that is generally aligned with a frontal region of the outer shell. The at least one primary rear bellows chamber is associated with a first stage rear pad section that is generally aligned with an aft region of the outer shell. The plurality of primary side bellows chambers are associated with a plurality of first stage side pad sections disposed below the first stage crown pad and between the first stage front and rear pad sections and which are generally aligned with side regions of the outer shell. Finally, the pair of primary ear bellows chambers are associated with a pair of first stage ear pad sections disposed below the first stage side pad sections and which are generally aligned with an ear/jaw region of the outer shell.

In accordance with a related exemplary embodiment of the CAD assembly, the secondary bellows unit may include a plurality of interconnected secondary bellows chambers configured and arranged to define at least one secondary crown bellows chamber, at least one secondary front bellows chamber, at least one secondary rear bellows chamber, a plurality of secondary side bellows chambers, and a pair of secondary ear bellows chambers. The at least one secondary crown bellows chamber is associated with a second stage crown pad section that is generally aligned with a crown region of the helmet wearer's head. The at least one secondary front bellows chamber is associated with a second stage front pad section that is generally aligned with a front region of the helmet wearer's head. The at least one secondary rear bellows chamber is associated with a second stage rear pad section that is generally aligned with a rear region of the helmet wearer's head. The plurality of secondary side bellows chambers are associated with a plurality of second stage side pad sections disposed below the second stage crown pad section and between the second stage front and rear pad sections and which are generally aligned with side regions of the helmet wearer's head. Finally, the pair of secondary ear bellows chambers are associated with a pair of second stage ear pad sections disposed below the second stage side pad sections and which are generally aligned with an ear/jaw region of the helmet wearer's head.

In accordance with a still further related embodiment of the CAD assembly, the first stage pad sections associated with the primary bellows unit extend outwardly from a primary base section that is mounted to the outer surface of the inner shell liner while the second stage pad sections associated with the secondary bellows unit extend inwardly from a secondary base section that is mounted to the inner surface of the inner shell liner. Air transfer holes extending through the inner shell liner facilitate the transfer of air between aligned sets of primary and secondary bellows chambers associated with corresponding first stage pad sections and second stage pad sections.

In accordance with yet another exemplary embodiment of the CAD assembly, the first stage pad sections provide an initial cushion of air and function to dampen an impact applied to the outer shell of the protective helmet by delaying the impact force from being transferred to the head of the wearer of the protective helmet. Specifically, collapse of the first stage pad sections upon the impact acts to forcibly transfer air out of the primary air charge holes as well between the interconnected primary bellows chambers so as to spread the impact force and dissipate the magnitude of the impact force transferred from the outer shell to the primary bellows unit. In addition, air is also forcibly transferred through the air transfer holes into the secondary bellows chambers of the corresponding second stage pad sections. Subsequent collapse of the second stage pad sections upon engagement with the wearer's head acts to forcibly transfer air out of the secondary air charge holes as well as between the interconnected secondary bellows chambers. Air is thereafter transferred from the secondary bellows chambers through the air transfer holes and back into the primary bellows chambers, thereby continuously filling and refilling interconnected pairs of primary and secondary bellows chambers so as to disperse the impact forces around and out of the protective helmet.

In accordance with other objectives of the present disclosure, the primary bellows unit can be fabricated as a one-piece molded primary pad component that is rigidly bonded to the outer surface of the inner shell liner. Likewise, the secondary bellows unit can be fabricated as a one-piece molded secondary pad component that is rigidly bonded to the inner surface of the inner shell liner. The primary pad component may include a primary base section from which the first stage pad sections extend and which is configured to be bonded in an air-tight manner relative to the outer surface of the inner shell liner. Likewise, the secondary pad component may include a secondary base section from which the second stage pad sections extend and which is configured to be bonded in an air-tight manner relative to the inner surface of the inner shell liner. The primary air bridge channels may be formed in the primary base section to fluidically interconnect adjacent primary bellows chambers associated with the first stage pad sections. Likewise, the secondary air bridge channels may be formed in the secondary base section to fluidically interconnect adjacent secondary bellows chambers associated with the second stage pad sections.

In accordance with a related objective of the present disclosure, the primary base section of the primary pad component may be thermally bonded to the outer surface of the inner shell liner while the secondary base section of the secondary pad component may be thermally bonded to the inner surface of the inner shell liner. The thermal bonding may be provided by use of an ultrasonic welding process capable of generating a welded seam or attachment zones between each of the first stage pad sections associated with the primary pad component and each of the second stage pad sections associated with the secondary pad component and the respective outer and inner surfaces of the inner shell liner.

In accordance with alternative objectives of the present disclosure, the primary and secondary pad components may be adhesively bonded to respective outer and inner surfaces of the inner shell liner. Additionally, the CAD assembly may include a plurality of primary bellows subunits configured as a plurality of molded primary pad components that are each bonded to the outer surface of the inner shell liner and interconnected via primary air bridge channels to provide a continuous primary air transfer flow circuit. Likewise, the CAD assembly may include a plurality of secondary bellows subunits configured as a plurality of molded secondary pad components that are each bonded to the inner surface of the inner shell liner and interconnected via secondary air bridge channels to provide a continuous secondary air transfer flow circuit. The use of separate primary and secondary bellows sub-units provides the CAD assembly with a modularity feature which facilitates optimization of the dual-stage air dissipation technology.

In accordance with other objectives, a plurality of independent CAD assemblies can be provided for attachment within the outer shell of the protective helmet. Each independent CAD assembly, hereinafter referred to as a CAD pad assembly, includes a primary pad component, a secondary pad component, and an inner liner plate disposed between the primary and secondary pad components. The primary pad component is secured in a sealed air-tight manner to a first or outer surface of the liner plate. The primary pad component includes a plurality of primary bellows chambers which can be interconnected by primary air transfer channels to facilitate the transfer of air between adjacent primary bellows chambers. The primary bellows chambers are established between the outer surface of the liner plate and a plurality of first stage pad sections. A primary air charge hole may extend through at least one of the first stage pad sections to permit ambient air to communicate with the interconnected plurality of primary bellows chambers. The secondary pad component is secured in a sealed air-tight manner to a second or inner surface of the liner plate. The secondary pad component includes a plurality of secondary bellows chambers which can be interconnected by secondary air transfer channels to facilitate the transfer of air between adjacent secondary bellows chambers. The secondary bellows chambers are established between the inner surface of the liner plate and a plurality of second stage pad sections. A secondary air charge hole may extend through at least one of the second stage pad sections to permit ambient air to communicate with the interconnected plurality of secondary bellows chambers. At least one air transfer hole extends through the liner plate to facilitate the transfer of air between at least one corresponding pair of aligned primary and secondary bellows chambers. Each CAD pad assembly includes an attachment mechanism for releasably mounting the primary pad component to the inner surface of the outer shell.

In accordance with a protective helmet equipped with a plurality of CAD pad assemblies, the present disclosure further includes providing one or more primary air transfer conduits for fluidically interconnecting a primary bellows chamber of one CAD pad assembly with a primary bellows chamber of another CAD pad assembly. Likewise, one or more secondary air transfer conduits may be provided for fluidically interconnecting a secondary bellows chamber of one CAD pad assembly with a secondary bellows chamber of another CAD pad assembly. The primary and secondary air transfer conduits provide primary and secondary air flow circuits between the fluidically interconnected CAD pad assemblies.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figures 17A, 17B:
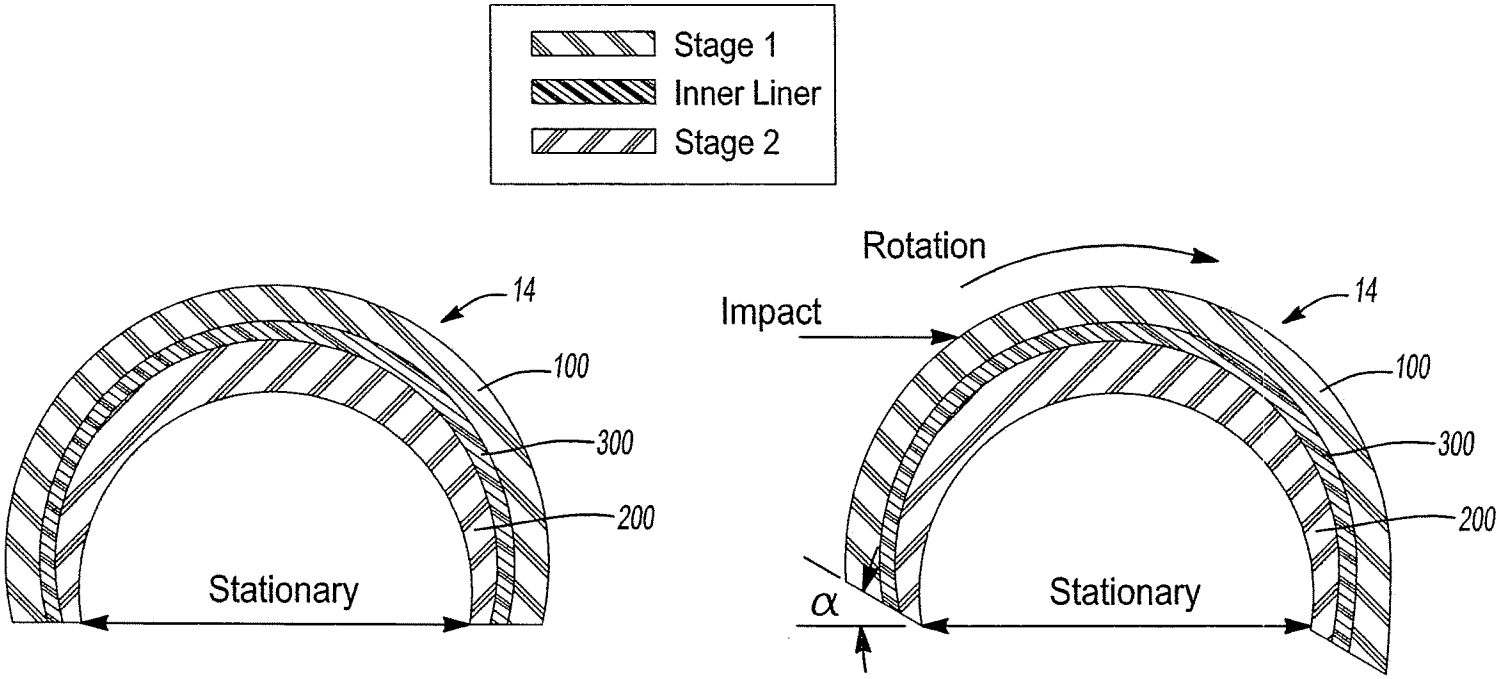
Figure 18:
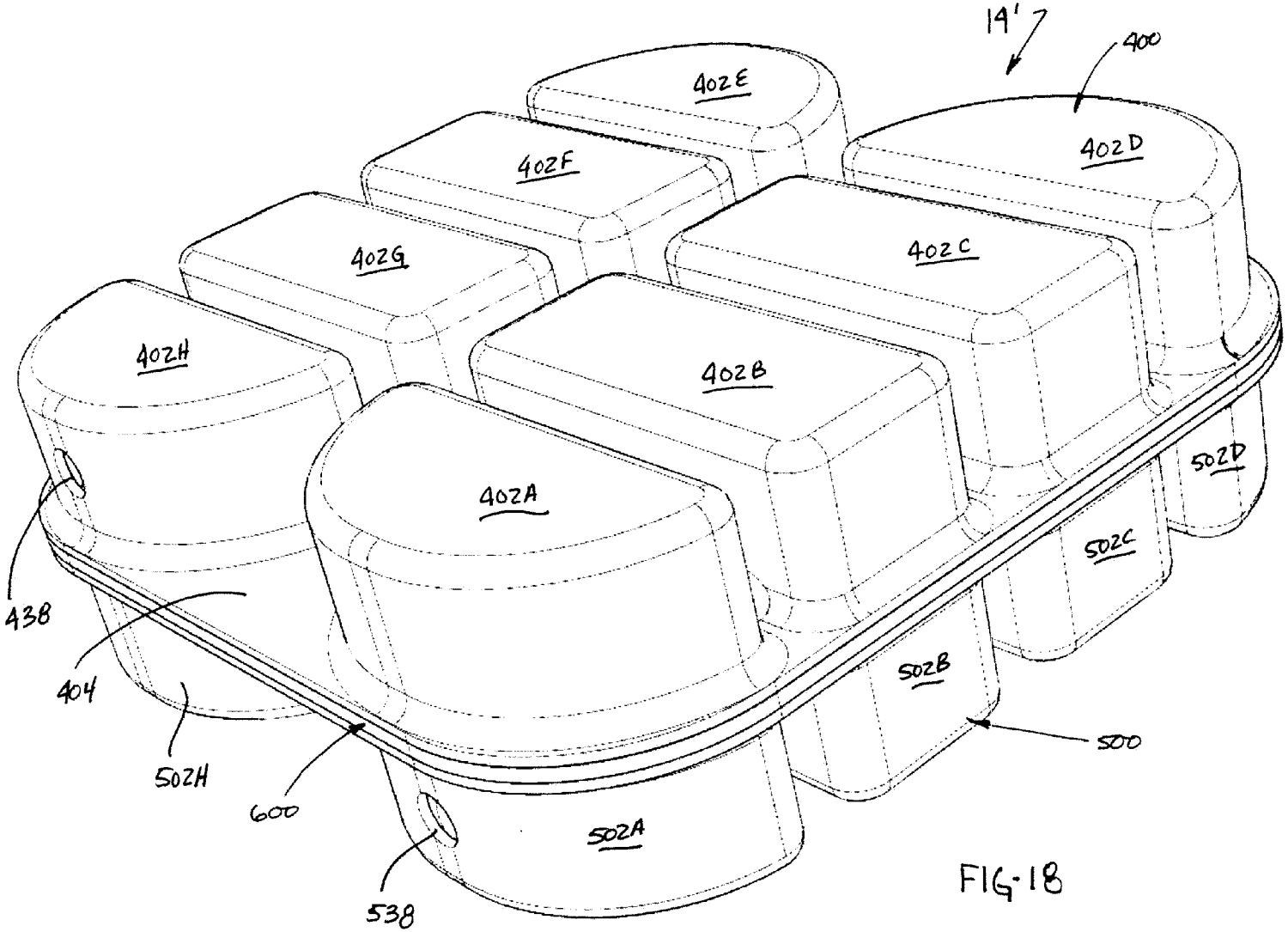
Figure 19:
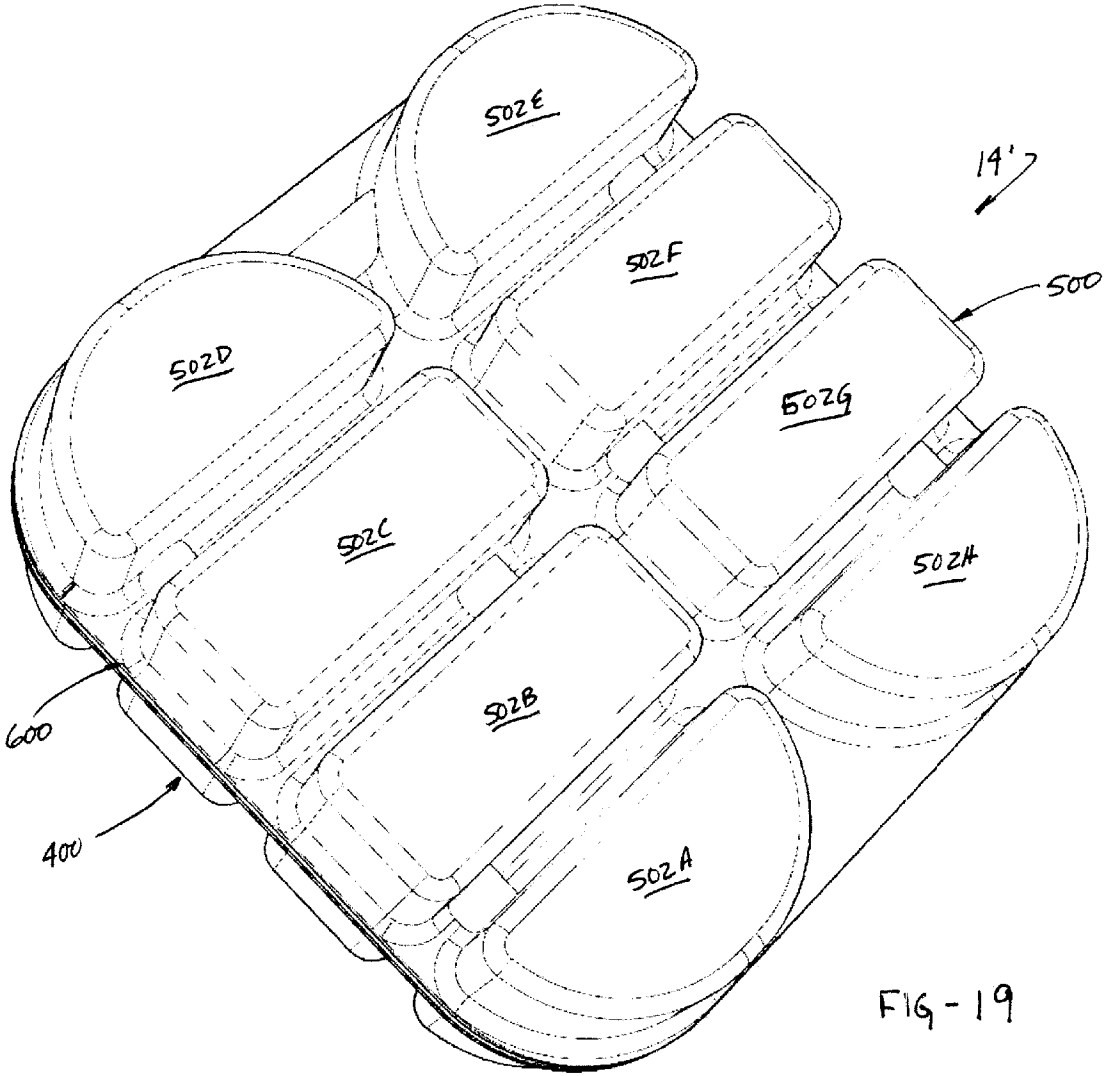
Figure 20:
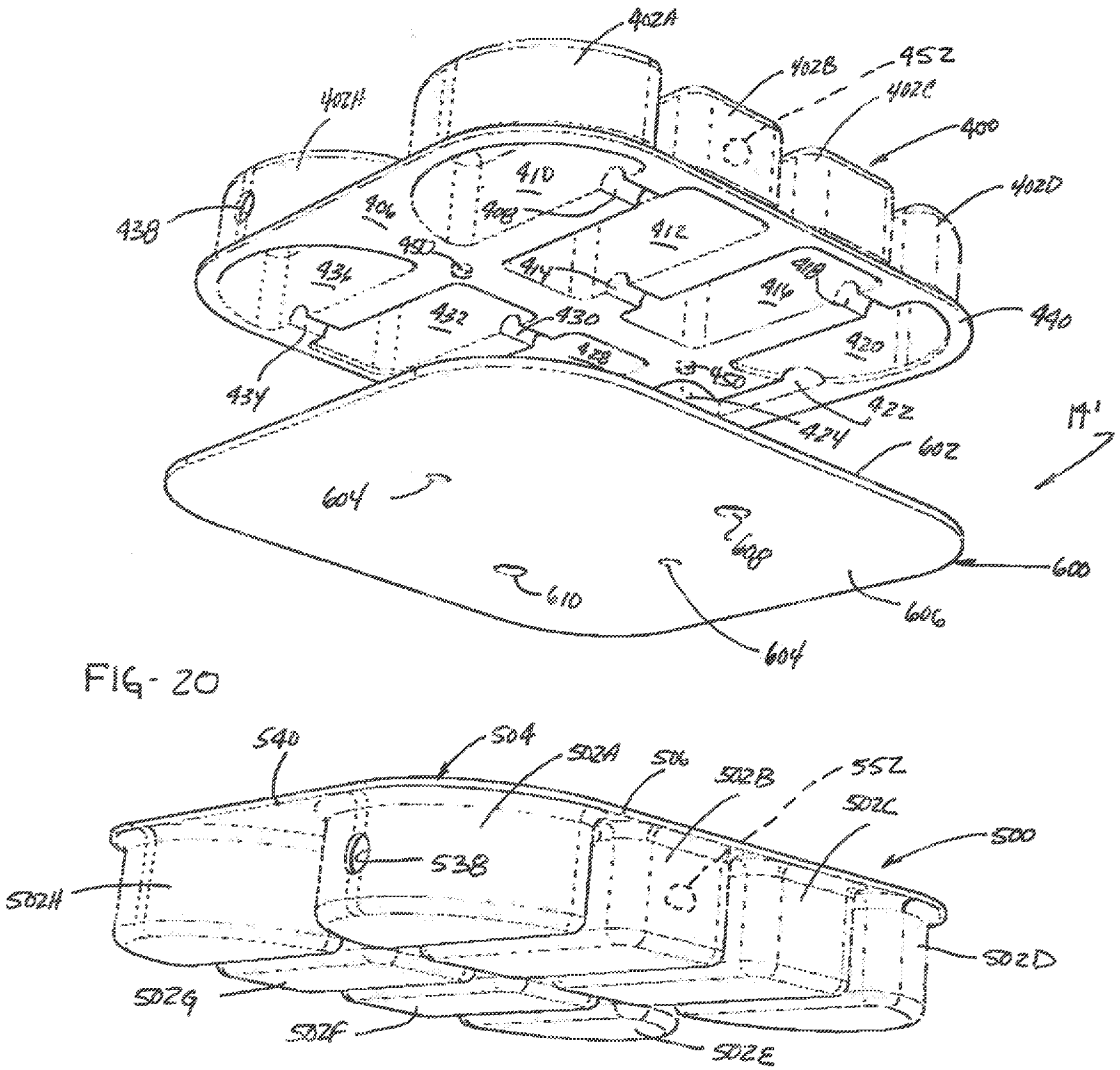
Figure 21:
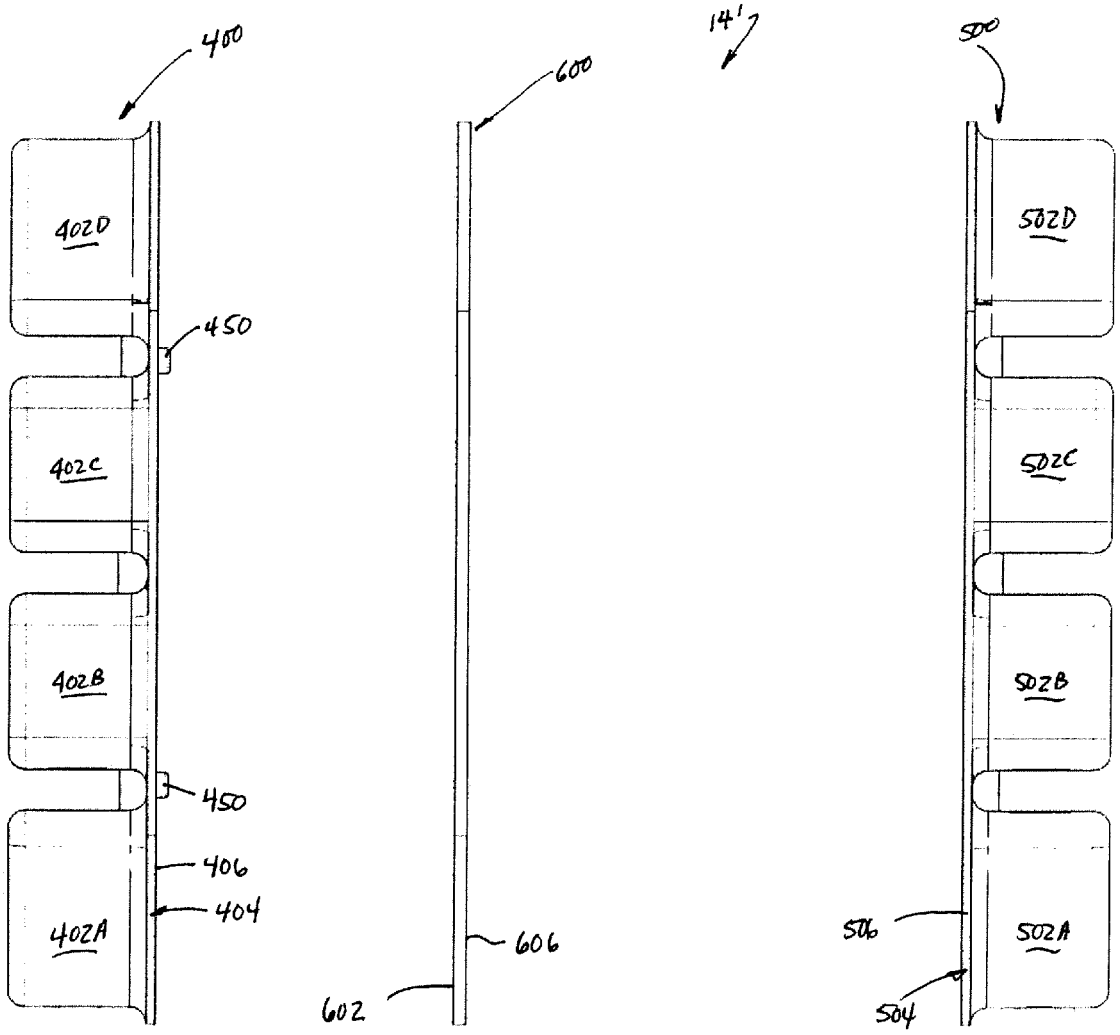
Figure 22:
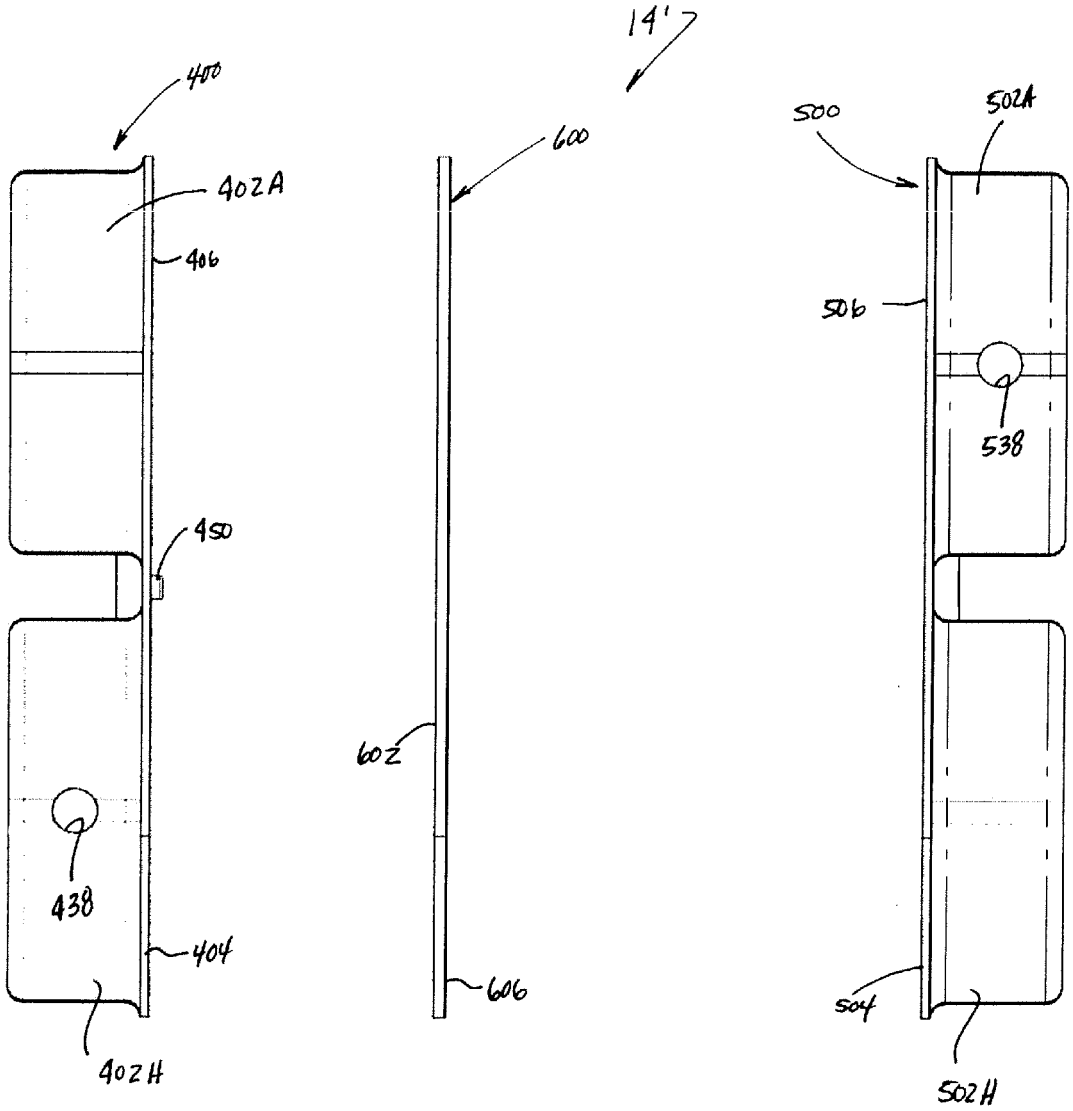
Figure 23:
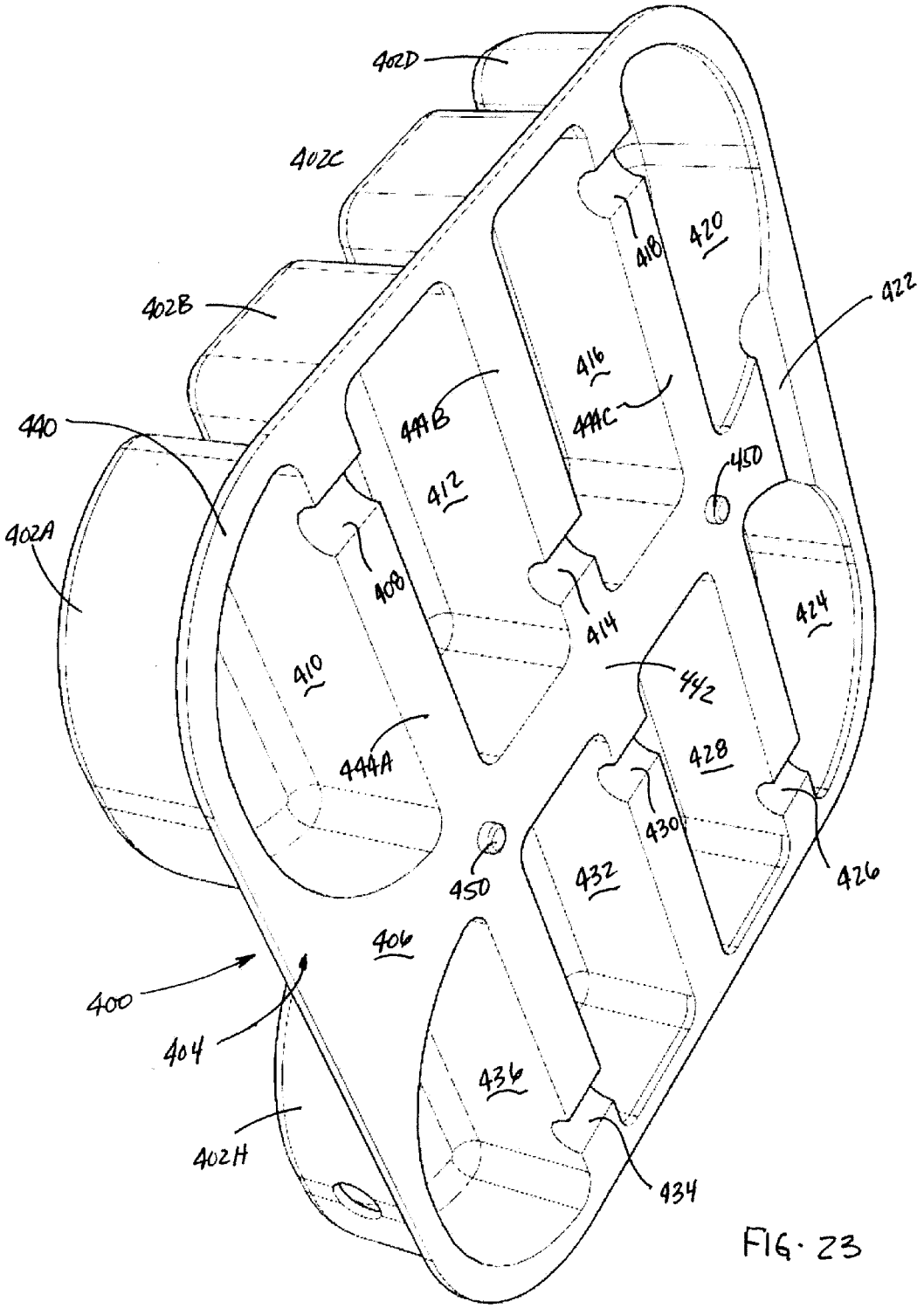
Figure 24:
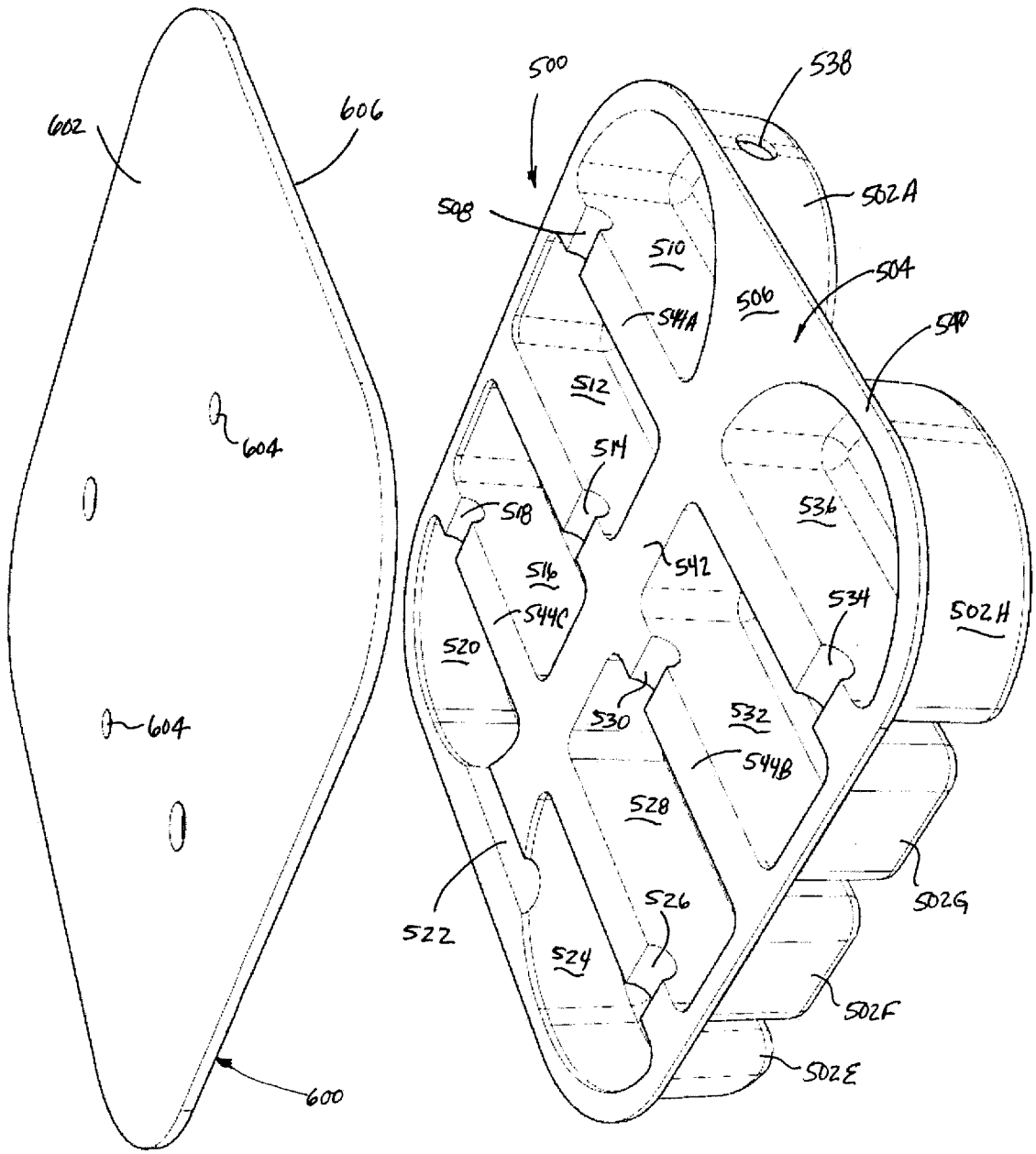
Figure 25:
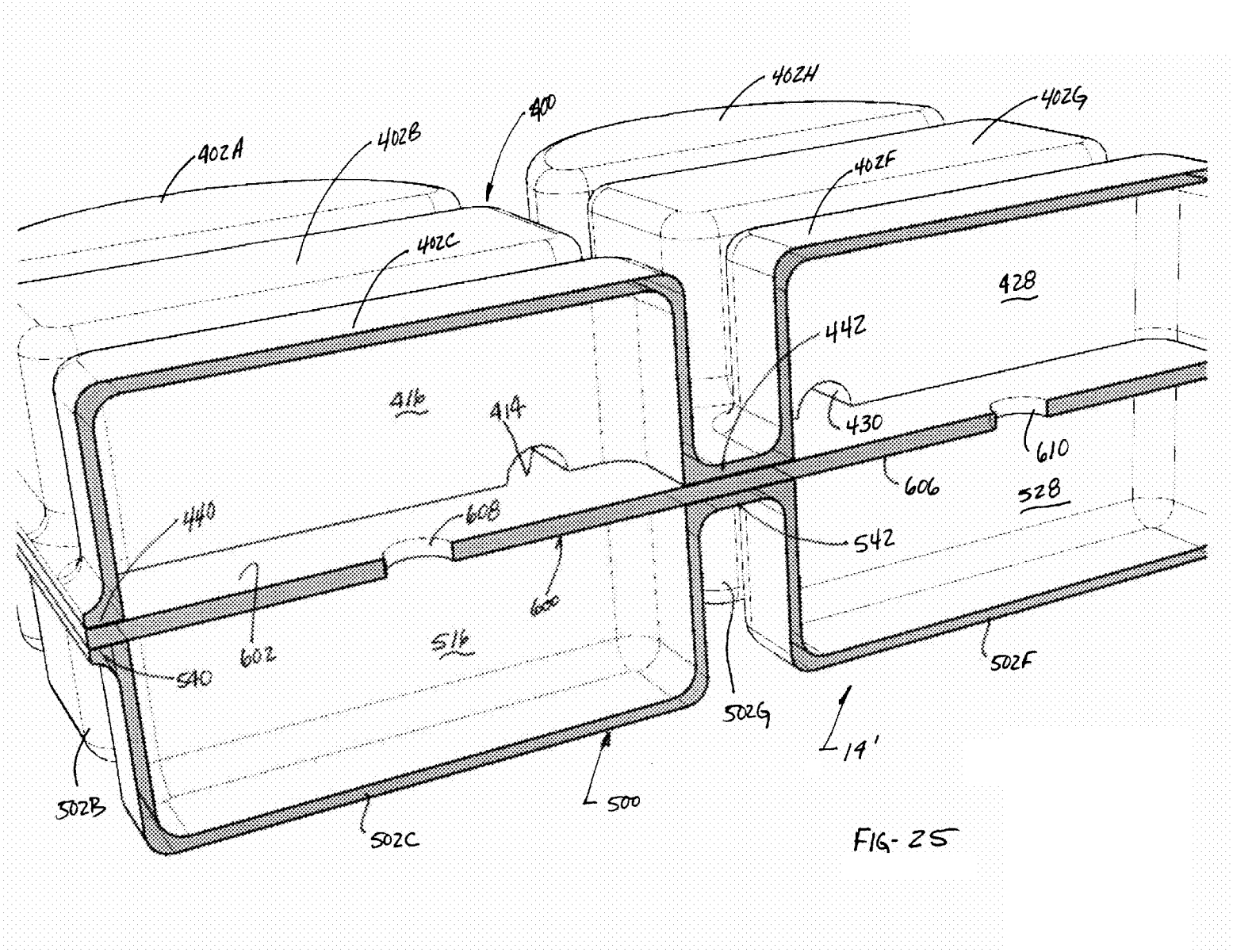
Figure 26:
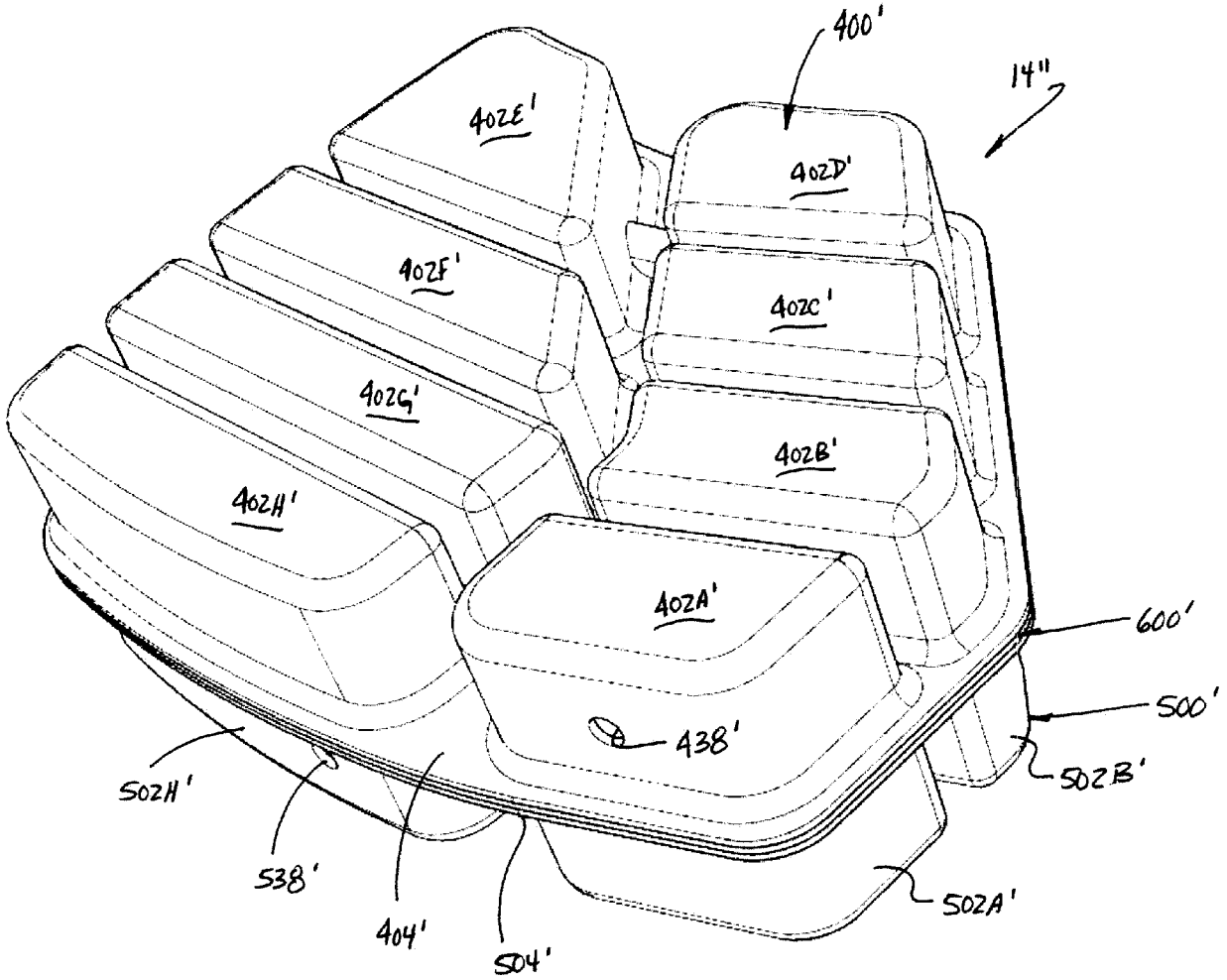
Figure 27:
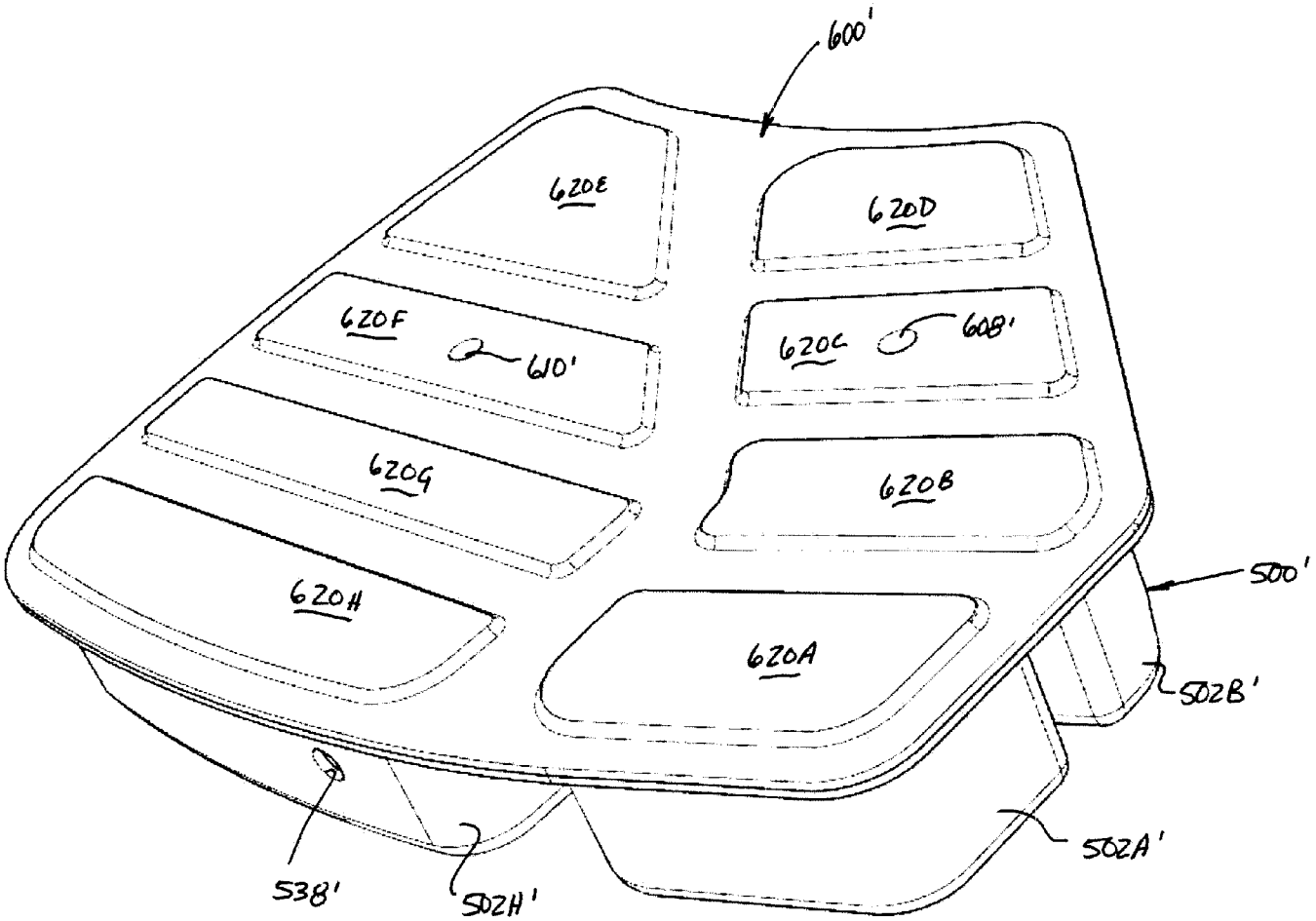
Figure 28:
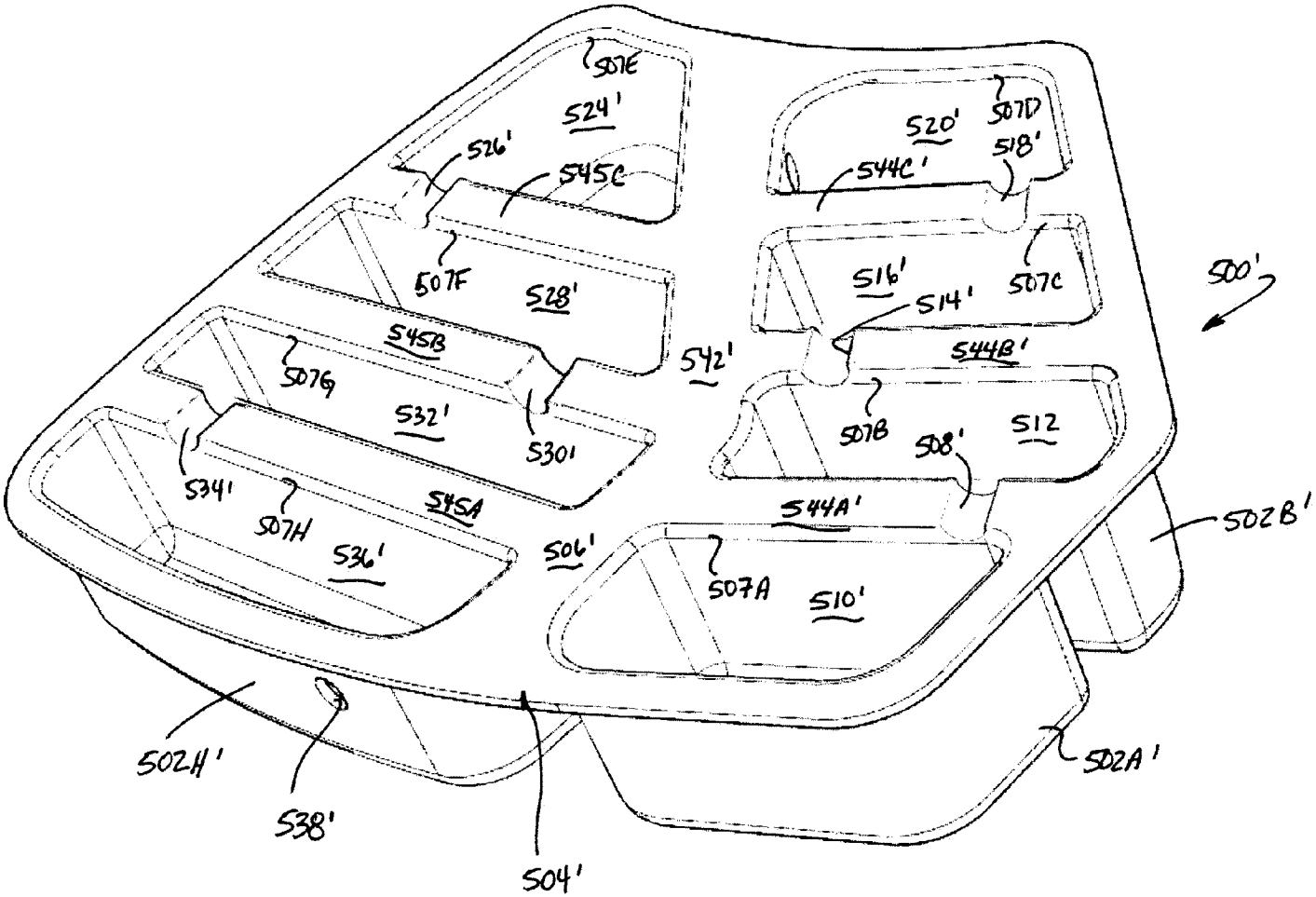
Figure 29:
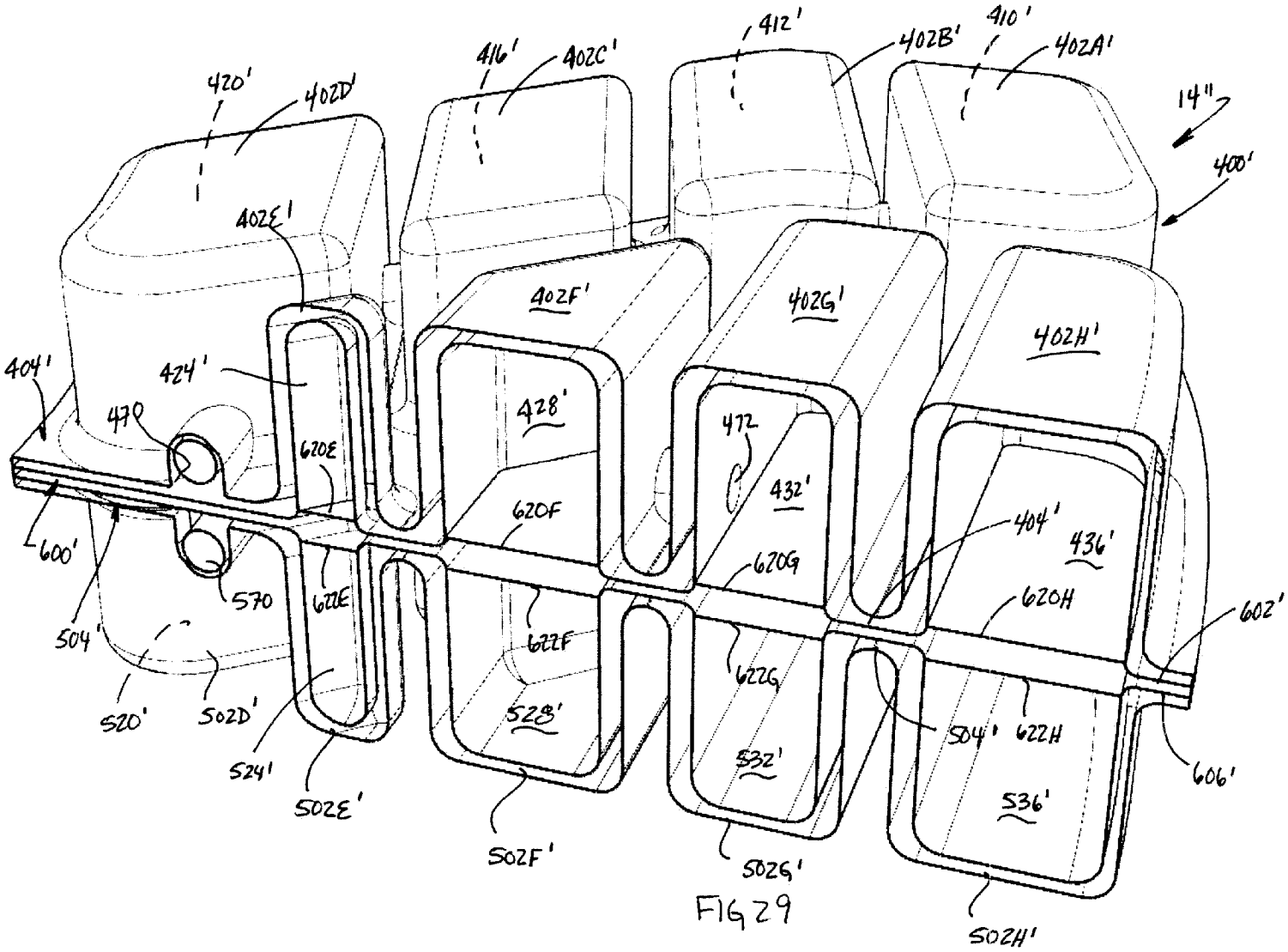

FIGS. 17A and 17B graphically illustrates action of the CAD assembly in response to a rotational acceleration condition;

FIG. 18 is an isometric view of a pad assembly for use in association with a modular CAD assembly constructed in accordance with an alternative embodiment of the present disclosure;

FIG. 19 is a bottom isometric view of the pad assembly shown in FIG. 18;

FIG. 20 is an exploded perspective view of the pad assembly shown in FIGS. 18 and 19;

FIG. 21 is a side view of the exploded pad assembly shown in FIG. 20;

FIG. 22 is an end view of the exploded pad assembly shown in FIG. 20;

FIG. 23 is a perspective view of a primary pad component associated with the pad assembly shown in FIGS. 18-22;

FIG. 24 is a perspective view of a secondary pad component and a liner component associated with the pad assembly shown in FIGS. 18-22;

FIG. 25 is a sectional view of the pad assembly shown in FIG. 19;

FIG. 26 is an isometric view of a pad assembly for use in association with a modular CAD assembly constructed in accordance with another alternative embodiment of the present disclosure;

FIG. 27 is a view of the pad assembly shown in FIG. 26 with its primary pad component removed from the liner component;

FIG. 28 is a perspective view of a secondary pad component associated with the pad assembly of FIG. 26; and FIG. 29 is a sectional view taken through the pad assembly of FIG. 26.

DETAILED DESCRIPTION

Example embodiments will now be described more fully with reference to the accompanying drawings. However, the example embodiments are solely provided so that this disclosure will be thorough and fully convey the scope of the present disclosure to those who are skilled in the art. To this end, numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure is generally directed to a protective helmet incorporating a novel and unobvious air transfer and metering technology, hereinafter referred to as "dual-stage air dissipation technology", for use in absorbing and/or transferring impact loads imparted onto the helmet's outer shell prior to transmission of such impact loads to the head of the helmet wearer. While a specific type of protective helmet is shown in the drawings, particularly a football helmet, those skilled in the art will appreciate and acknowledge that the dual-stage air dissipation technology of the present disclosure can be readily incorporated into any other types of protective helmets used by a wearer to provide head protection. To this end, it is contemplated that the teachings of the present disclosure are applicable to protective helmets used for other activities including, but not limited to, baseball, hockey, lacrosse, cycling, motor racing (i.e., on-road and off-road), moto-cross and motorcycles as well as for use in military applications.

Figure 1:
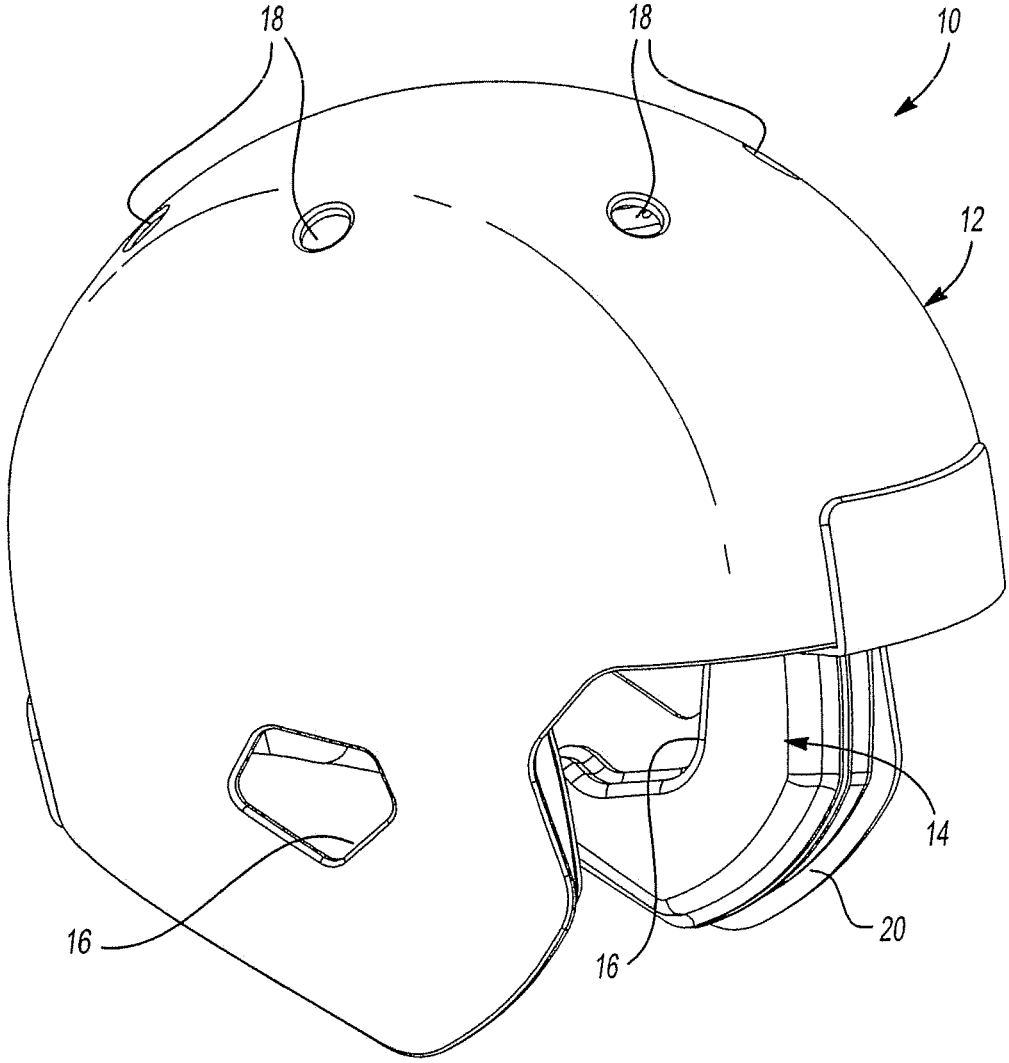
FIG. 1 is an isometric view of a protective helmet configured and constructed in accordance with the teachings of the present disclosure to include a rigid outer shell and a controlled air dissipation ("CAD") assembly attached within the outer shell.

Referring primarily to FIG. 1, a protective helmet 10 constructed in accordance with the teachings of the present disclosure is shown to generally include an outer shell 12 and a controlled air dissipation assembly, hereafter referred to as CAD assembly 14. Outer shell 12 is an otherwise conventional helmet configuration of the type commonly used as part of a football helmet and is shown to include ear holes 16 and a plurality of vent holes 18. Those skilled in the art will recognize that a face mask (not shown) can be secured to an open front portion of outer shell 12 in a known manner. Additionally, outer shell 12 can include snaps (not shown) to facilitate attachment of a chin strap thereto. While not specifically limited thereto, outer shell can be fabricated from a suitable rigid material, such as polycarbonate or ABS. As will be detailed, CAD assembly 14 is adapted to be removably secured within an inner cavity of outer shell 12 in proximity to an inner wall surface 20 thereof.

Figure 2:
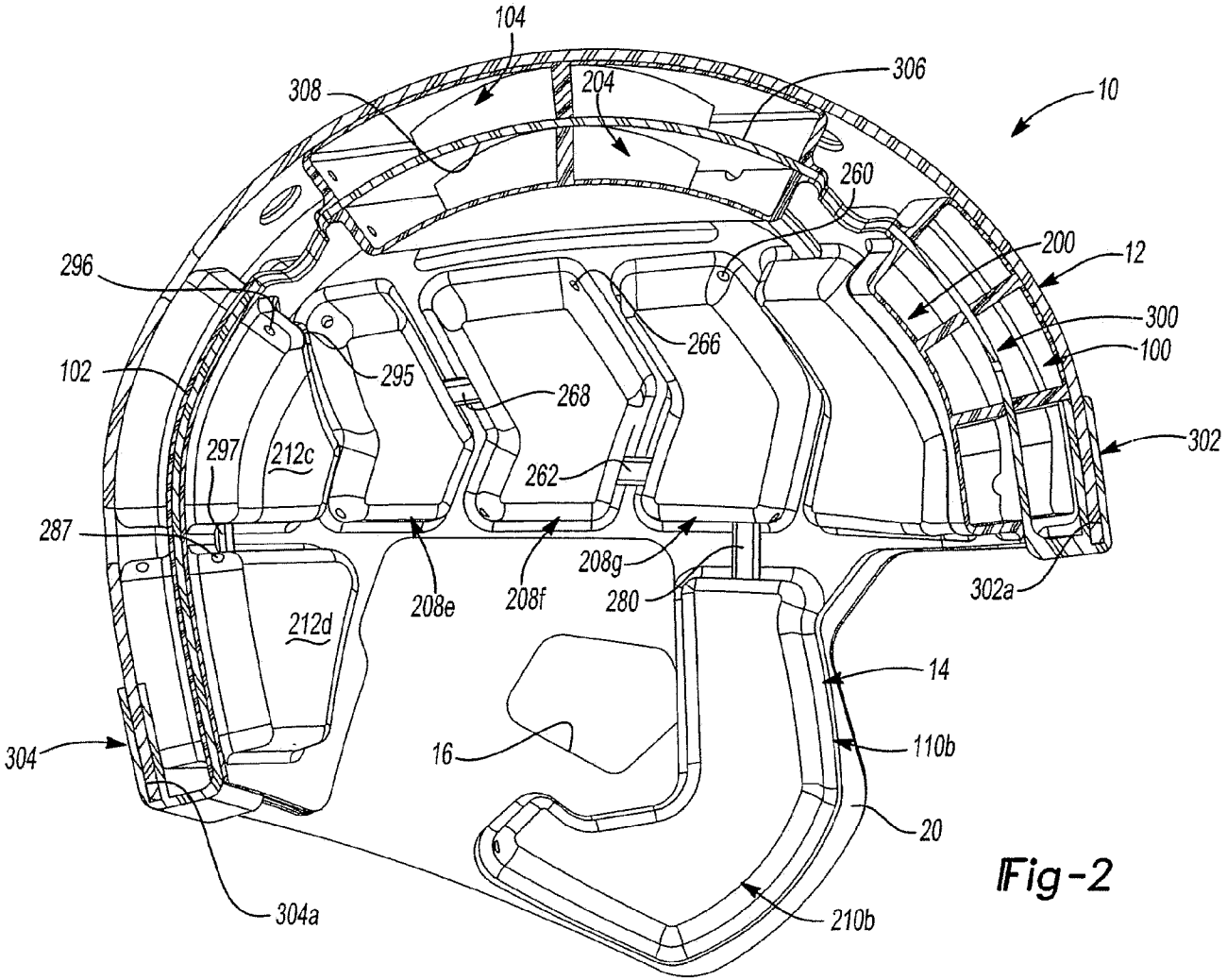
FIG. 2 is a sectional view of the protective helmet shown in FIG. 1 and which illustrates the mounting structure utilized to removably attach the CAD assembly within the rigid outer shell.
Figure 3:
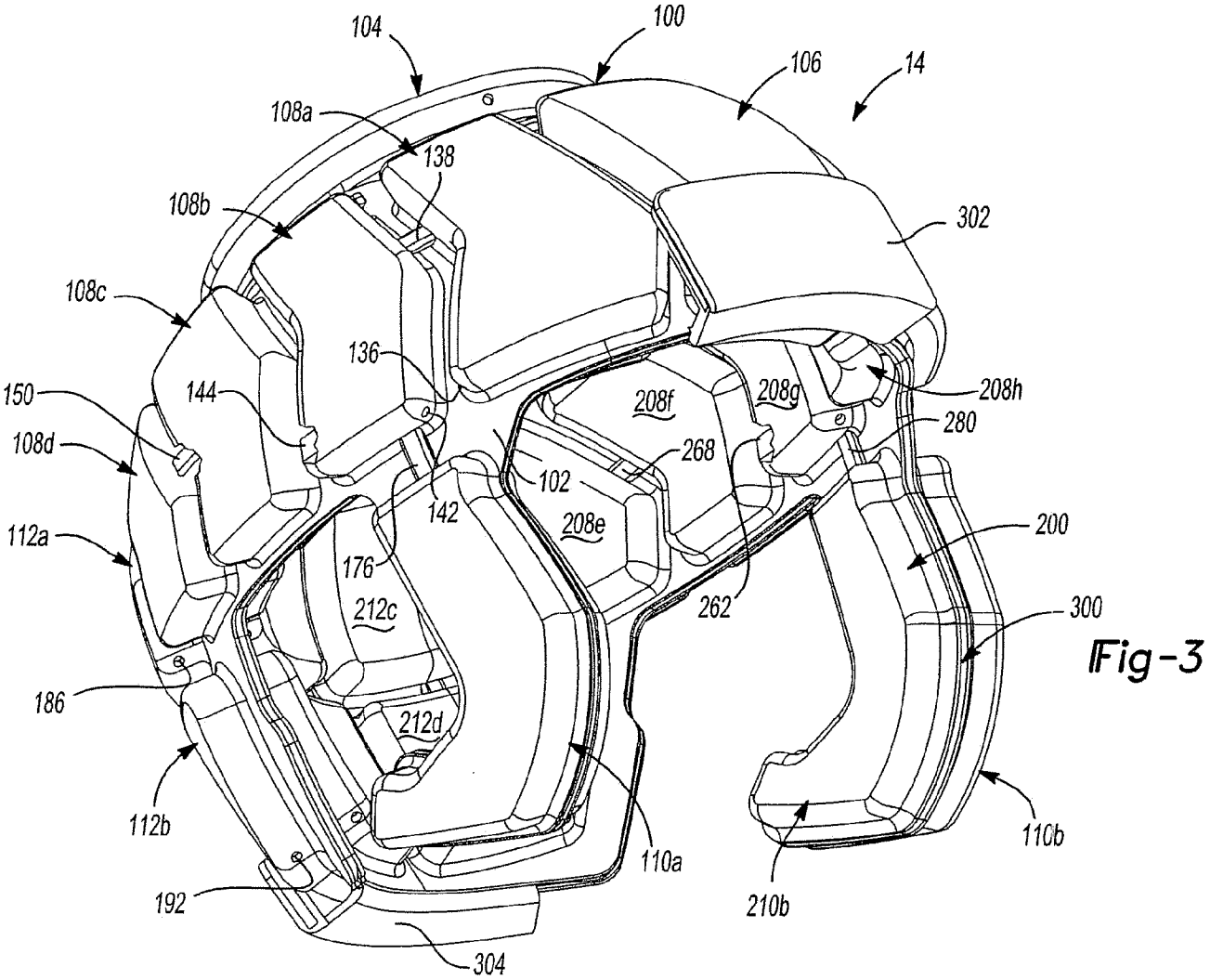
FIG. 3 is an isometric view of the CAD assembly removed from the outer shell of the protective helmet and showing the CAD assembly to include a primary bellows unit, a secondary bellows unit, and an inner shell liner disposed between the primary and secondary bellows units.

Referring now primarily to FIGS. 2 and 3, CAD assembly 14 is shown generally as a three component assembly comprised of an outer or primary bellows unit 100, an inner or secondary bellows unit 200, and an inner shell liner 300 that is disposed between primary bellows unit 100 and secondary bellows unit 200. Inner shell liner 300 is a helmet-shaped component and is shown to include a front U-shaped mounting flange 302 and a rear U-shaped mounting flange 304, each having a corresponding mounting groove 302A, 304A that is sized to accept and retain front and rear portions of outer shell 12 therein. While not shown, fasteners can be used to secure mounting flanges 302 and 304 to outer shell 12. Based on this exemplary construction, CAD assembly 14 can be easily installed or removed from the internal cavity of outer shell 12 using the mounting structure associated with inner shell liner 300.

As will be detailed hereinafter with much greater specificity, primary bellows unit 100 includes a plurality of first stage pad sections each defining a primary bellows chamber that is in fluid communication with at least one other adjacent primary bellows chamber and which are in communication with ambient air via primary air charge holes. An outer surface of the first stage pad sections is configured to engage, or be located in close proximity to, inner surface 20 of outer shell 12. Likewise, secondary bellows unit 200 includes a plurality of second stage pad sections each defining a secondary bellows chamber that is in fluid communication with at least one other adjacent secondary bellows chamber and which are in communication with ambient air via secondary air charge holes. The second stage pad sections are configured to engage, or be in close proximity to, the head of a person wearing protective helmet 10. Inner shell liner 300 includes a plurality of air transfer holes that facilitate the transfer of air between corresponding sets of aligned primary and second bellows chambers. Accordingly, CAD assembly 14 is configured to define a dual stage air dissipation and metering system which, upon an impact force being applied to outer shell 12, facilitates: A) the transfer of air between adjacent primary bellows chambers; B) the transfer of air between adjacent secondary bellows chambers; and C) the transfer of air between aligned sets of primary and secondary bellows chambers.

In accordance with this dual stage air dissipation and metering system, the above-noted transfer of ambient air is controlled and regulated to dissipate the impact forces applied to helmet 10. Upon the head of the helmet wearer encountering an impact, one or more of the first stage pad sections and, subsequently, one or more of the second stage pad sections are resiliently deflected to cause a regulated and controlled transfer of air between adjacent bellows chambers. This regulated air transfer is operable to react against the forces associated with the impact and create an air-cushioned energy dissipation process. This energy dissipation process is operable to spread the impact forces to a much larger area, thereby delaying the time between actual impact and the subsequent release of the energy created and ultimately transferred to the wearer's head.

Primary bellows unit 100 of CAD assembly 14 is generally shown to include a plurality of first stage pad sections extending outwardly from a primary base section 102 having an inner mounting surface 101 that, in turn, is adapted to be secured in an air-tight manner to an outer surface 306 of inner shell liner 300. Since the first stage pad sections are normally filled with non-pressurized ambient air, they are configured to deflect in response to an impact load applied to outer shell 12. It is contemplated that primary bellows unit 100 can be a one-piece molded component fowled from a suitably semi-rigid, yet resilient material. Non-limiting examples of suitable materials may include TPU (Thermal Plastic Urethane), TPE (Thermal Polyester Elastomer) or a blended Thermal Elastomer.

The first stage pad sections can be grouped into distinct sections associated with base section 102. Specifically, the first stage pad sections may include at least one crown pad section 104, at least one front pad section 106, a plurality of peripheral side pad sections 108A-108H, a pair of ear pad sections 110A, 1106, and a plurality of rear pad sections 112A-112D. FIG. 3 illustrates the first stage pad sections mentioned above extending outwardly from primary base section 102. FIGS. 4 and 6 through 9 illustrate these first stage pad sections in a generally translucent manner to better define and show one or more internal baffle projections that may be formed in each of the corresponding primary bellows chambers. The arrangement and function of such internal baffle projections will be described hereinafter in greater detail.

With primary reference to FIGS. 4 through 10, the specific construction and features associated with primary bellows unit 100 will now be described in more detail. Upon installation of CAD assembly 14 into outer shell 12, crown pad section 104 will be located at a crown region of outer shell 12 and is generally configured to be arcuate and define a generally cylindrical primary crown bellows chamber 114. An inner surface of crown pad section 104 within primary crown bellows chamber 114 is shown to include a cross-shaped baffle projection 115 extending downwardly therefrom and which projects toward outer surface 306 of inner shell liner 300. Cross-shaped baffle projection 115 generally segregates primary crown bellows chamber 114 into quadrants and facilitates a radially outward and centrifugal air flow pattern therein. A pair of primary air charge holes 116 extend through crown pad section 104 to permit ambient air to communicate with front and back portions of primary crown bellows chamber 114.

A first primary air bridge channel 118 is shown to interconnect primary crown bellows chamber 114 for fluid communication with a primary side bellows chamber 120 associated with side pad section 108D while a second primary air bridge channel 122 is shown to interconnect primary crown bellows chamber 114 for fluid communication with a primary side bellows chamber 124 associated with side pad section 108H. Each of the primary air bridge channels described hereinafter may be configured as a tubular passage extending outwardly from base section 102 between a pair of primary bellows chambers.

Figure 4:
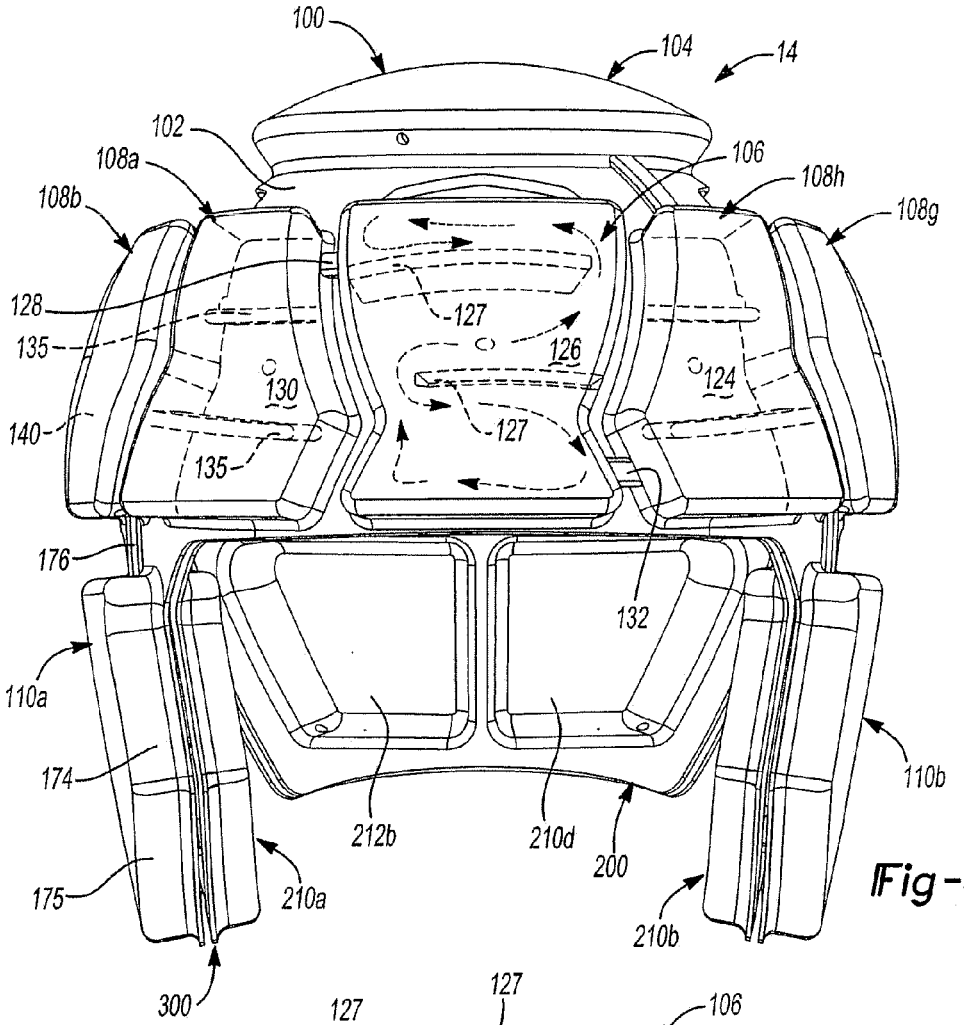
FIG. 4 is a frontal isometric view of the CAD assembly, with portions of the mounting structure associated with the inner shell liner removed for additional clarity.

Upon installation of CAD assembly 14 within outer shell 12, front pad section 106 of primary bellows unit 100 is oriented to be located at a forward region of outer shell 12 and defines a primary front bellows chamber 126. A plurality of elongated baffle projections 127 extend downwardly into primary front bellows chamber 126 to form a labyrinth type air flow pattern therein (FIG. 4). A third primary air bridge channel 128 is shown to provide fluid communication between primary front bellows chamber 126 and a primary side bellows chamber 130 associated with side pad section 108A. Likewise a fourth primary air bridge channel 132 provides fluid communication between primary front bellows chamber 126 and primary side bellows chamber 124 associated with side pad section 108H. A primary air charge hole 134 extends through front pad section 106 to permit ambient air to communicate with primary front bellows chamber 126.

As noted, side pad section 108A defines primary side bellows chamber 130. A pair of elongated baffle projections 135 extend downwardly into primary side bellows chamber 130 to establish a labyrinth type air flow pattern therein. A primary air charge hole 136 extends through side pad section 108A to permit ambient air to communicate with primary side bellows chamber 130. A fifth primary air bridge channel 138 provides fluid communication between primary side bellows chamber 130 of side pad section 108A and a primary side bellows chamber 140 associated with side pad section 108B. A pair of elongated baffle projections 141 extend downwardly into primary side bellows chamber 140 to establish a labyrinth type air flow pattern therein. A primary air charge hole 142 extends through side pad section 108B to permit ambient air to communicate with primary side bellows chamber 140. A sixth primary air bridge channel 144 provides fluid communication between primary side bellows chamber 140 of side pad section 108B and a primary side bellows chamber 146 associated with side pad section 108C. A pair of elongated baffle projections 147 extend downwardly into primary side bellows chamber 146 to establish a labyrinth type air flow pattern therein. A primary air charge hole 148 extend through side pad section 108C to permit ambient air to communicate with primary side bellows chamber 146.

A seventh primary air bridge channel 150 provides fluid communication between primary side bellows chamber 146 of side pad section 108C and primary side bellows chamber 120 associated with side pad section 108D. A pair of elongated baffle projections 153 extend downwardly into primary side bellows chamber 120 to establish a labyrinth type air flow pattern therein. A primary air charge hole 154 extends through side pad section 108D to permit ambient air to communicate with primary side bellows chamber 120.

As previously disclosed, primary side bellows chamber 124 of side pad section 108H is in fluid communication with primary crown bellows chamber 114 of crown pad section 104 via second primary air bridge channel 122 and is also in fluid communication with primary front bellows chamber 126 of front pad section 106 via fourth primary air bridge channel 132. Primary side bellows chamber 124 of side pad section 108H is also in fluid communication with a primary side bellows chamber 156 associated with side pad section 108G via an eighth primary air bridge channel 158. A pair of elongated baffle projections 159 extend downwardly into primary side bellows chamber 156 so as to establish a labyrinth type air flow pattern therein. A primary air charge hole 160 extends through side pad section 108G to permit ambient air to communicate with primary side bellows chamber 156.

A ninth primary air bridge channel 162 provides fluid communication between primary side bellows chamber 156 of side pad section 108G and a primary side bellows chamber 164 associated with side pad section 108F. A pair of elongated baffle projections 165 extend into primary side bellows chamber 164 and establish a labyrinth type air flow pattern therein. A primary air charge hole 166 extends through side pad section 108F to permit ambient air to communicate with primary side bellows chamber 164. A tenth primary air bridge channel 168 provides fluid communication between primary side bellows chamber 164 of side pad sections 108F and a primary side bellows chamber 170 associated with side pad section 108E. Baffle projections 169 extend into primary side bellows chamber 170 to establish a labyrinth type air flow pattern therein. A primary air charge hole 172 extends through side pad sections 108E to permit ambient air to communicate with primary side bellows chamber 170.

Right ear pad section 110A of primary bellows unit 100 defines a primary ear bellows chamber 174 having one or more elongated baffle projections 175 for establishing a labyrinth type air flow pattern therein. Primary ear bellows chamber 174 is in fluid communication with primary side bellows chamber 140 of side pad section 108B via an eleventh primary air bridge channel 176. A primary air charge hole 177 extends through ear pad section 110A to permit ambient air to communicate with primary ear bellows chamber 174. Similarly, left ear pad section 110B of primary bellows unit 100 defines a primary ear bellows chamber 178 having one or more elongated baffle projections 179 for establishing a labyrinth type air flow pattern therein. Primary ear bellows chamber 178 is in fluid communication with primary side bellows chamber 156 of side pad section 108G via a twelfth primary air bridge channel 180. A primary air charge hole 181 extends through ear pad section 110B to permit ambient air to communicate with primary ear bellows chamber 178.

Upon installation of CAD assembly 14 into outer shell 12, back pad sections 112A-112D of primary bellows unit 100 are aligned and position adjacent to a back region of inner surface 20 of outer shell 12. Upper back pad sections 112A and 112C are located above lower back pad sections 112B and 112D, respectively. Upper back pad section 112A defines a first primary upper back bellows chamber 182 that is in fluid communication with primary side bellows chamber 120 of side pad section 108D via a thirteenth primary air bridge channel 184. A pair of transversely oriented elongated baffle projections 185 extend into first primary upper back bellows chamber 182 and are arranged to establish a non-laminar air flow pattern therein. A primary air charge hole 186 extends through upper back pad section 112A to permit ambient air to communicate with first primary upper back bellows chamber 182. First primary upper back bellows chamber 182 of upper back pad section 112A is in fluid communication with a first primary lower back bellows chamber 188 associated with lower back pad section 1128 via a fourteenth air bridge channel 190. A pair of transversely oriented elongated baffle projections 191 extend into first primary lower back bellows chamber 188 and are arranged to establish a non-laminar air flow pattern therein. A primary air charge hole 192 extends through lower back pad section 1126 to permit ambient air to communicate with first primary lower back bellows chamber 188.

Similarly, upper back pad section 112C defines a second primary upper back bellows chamber 194 that is in fluid communication with primary side bellows chamber 170 of side pad section 108E via a fifteenth air bridge channel 195. A pair of transversely oriented elongated baffle projections 193 extend into second primary upper back bellows chamber 194 and are arranged to establish a non-laminar flow pattern therein. A primary air charge hole 196 extends through upper back pad section 112C to permit ambient air to communicate with second primary upper back bellows chamber 194. Second primary upper back bellows chamber 194 of upper back pad section 112C is in fluid communication with a second primary lower back bellows chamber 198 associated with lower back pad section 112D via a sixteenth air bridge channel 197. A pair of transversely oriented elongated baffle projections 199 are arranged to establish a non-laminar air flow pattern within second primary lower back bellows chamber 198. A primary air charge hole 187 extends through lower back pad section 112D to permit ambient air to communicate with second primary lower back bellows chamber 198.

As described above, primary bellows unit 100 of CAD assembly 14 includes a plurality of primary bellows chambers that are each in fluid communication with at least one other primary bellows chamber via a primary air bridge channel. When mounting surface 101 of base section 102 is attached to outer surface 306 of shell liner 300, the primary bellows chambers and the primary air bridge channels cooperate to define a continuous primary air flow circuit. While each of the primary air charge holes is noted to facilitate transfer of ambient air into and out of each of the primary bellows chamber, they also function to permit the release of moisture or condensation therefrom. It will be noted that a plurality of cut-outs 103 are formed in base section 102 of primary bellows unit 100 between first stage crown pad section 104 and first stage side pad sections 108A-108H to provide mass reduction and facilitate improved ventilation. These cut-outs 103 are matched in size and configuration to similar cut-outs 303 formed in inner shell liner 300 and cut-outs 203 formed in secondary bellows unit 200. Additional cut-outs may be provided between the ear pad sections and the lower back pad sections if desired.

Secondary bellows unit 200 of CAD assembly 14 is generally shown to include a plurality of second stage pad sections extending from a secondary base section 202 having an outer mounting surface 201 that, in turn, is adapted to be secured in an air-tight manner to an inner surface 308 of inner shell liner 300. Since the second stage pad sections are also filled with non-pressurized ambient air, they are configured to deflect in response to an impact load applied by the head of the helmet wearer. It is contemplated that secondary bellows unit 200 can be a one-piece molded component formed from a suitably semi-rigid, yet resilient material. Non-limiting examples of suitable materials may include TPU (Thermal Plastic Urethane), TPE (Thermal Polyester Elastomer) or a blended Thermal Elastomer.

The second stage pad sections can be grouped into distinct pad sections associated with base section 202. Specifically, the second stage pad sections may include at least one crown pad section 204, at least one front pad section 206, a plurality of peripheral side pad sections 208A-208H, a pair of ear pad sections 210A, 2108, and a plurality of rear pad sections 212A-212D. FIGS. 2 and 3 illustrate the second stage pad sections mentioned above extending inwardly from secondary base section 202. FIGS. 12 through 16 illustrate these second stage pad sections, some shown in a generally translucent manner, to better define and show one or more internal baffle projections that are formed in each of the corresponding secondary bellows chambers. In one preferred arrangement, the second pad sections are mirror-image versions of the first pad sections so as to be symmetrical relative to a plane through inner shell liner 300.

Upon installation of CAD assembly 14 into outer shell 12, second stage crown pad section 204 will be located at a crown region of the helmet wearer's head and is generally configured to be arcuate and define a generally cylindrical secondary crown bellows chamber 214. Secondary crown bellows chamber 214 is shown to include cross-shaped baffle projections 215 extending upwardly therefrom and which projects toward inner surface 308 of inner shell liner 300. Cross-shaped baffle 215 generally segregates secondary crown bellows chamber 214 into quadrants and facilitates a radially outward and centrifugal air flow pattern therein. A pair of secondary air charge holes 216 extend through crown pad section 204 to permit ambient air to communicate with secondary crown bellows chamber 214.

A first secondary air bridge channel 218 is shown to interconnect secondary crown bellows chamber 214 for fluid communication with a secondary side bellows chamber 220 associated with side pad section 208D while a second secondary air bridge channel 222 is shown to interconnect secondary crown bellows chamber 214 for fluid communication with a secondary side bellows chamber 224 associated with side pad section 208H. Each of the secondary air bridge channels described hereinafter may be configured as a tubular air flow passage extending from base section 202.

Upon installation of CAD assembly 14 within outer shell 12, second stage front pad section 206 of secondary bellows unit 200 is oriented to be located at a forward region of helmet 10 and defines a secondary front bellows chamber 226. A plurality of elongated baffle projections 227 extend into secondary front bellows chamber 226 to form a labyrinth type air flow pattern therein. A third secondary air bridge channel 228 is shown to provide fluid communication between secondary front bellows chamber 226 of front pad section 206 and a secondary side bellows chamber 230 associated with side pad section 208A. Likewise a fourth secondary air bridge channel 232 provides fluid communication between secondary front bellows chamber 226 of front pad section 206 and secondary side bellows chamber 224 of side pad section 208H. A secondary air charge hole 234 extends through front pad section 206 to permit ambient air to communicate with secondary front bellows chamber 226.

As noted, side pad section 208A defines secondary side bellows chamber 230. A pair of elongated baffle projections 235 extend into secondary side bellows chamber 230 to establish a labyrinth type air flow pattern therein. A secondary air charge hole 236 extends through side pad section 208A to permit ambient air to communicate with secondary side bellows chamber 230. A fifth secondary air bridge channel 238 provides fluid communication between secondary side bellows chamber 230 of side pad section 208A and a secondary side bellows chamber 240 associated with side pad section 208B. A pair of elongated baffle projections 241 extend into secondary side bellows chamber 240 to establish a labyrinth type air flow pattern therein. A secondary air charge hole 242 extends through side pad section 208B to permit ambient air to communicate with secondary side bellows chamber 240. A sixth secondary air bridge channel 244 provides fluid communication between secondary side bellows chamber 240 of side pad section 208B and a secondary side bellows chamber 246 associated with side pad section 208C. A pair of elongated baffle projections 247 extend into secondary side bellows chamber 246 to establish a labyrinth type air flow pattern therein. A secondary air charge hole 248 extends through side pad section 208C to permit ambient air to communicate with secondary side bellows chamber 246.

A seventh secondary air bridge channel 250 provides fluid communication between secondary side bellows chamber 246 of side pad section 208C and secondary side bellows chamber 220 associated with side pad section 208D. A pair of elongated baffle projections 253 extend into secondary side bellows chamber 220 to establish a labyrinth type air flow pattern therein. A secondary air charge hole 254 extends through side pad section 208D to permit ambient air to communicate with secondary side bellows chamber 220.

As previously disclosed, secondary side bellows chamber 224 of side pad section 208H is in fluid communication with secondary crown bellows chamber 214 of crown pad section 204 via second secondary air bridge channel 222 and is also in fluid communication with secondary front bellows chamber 226 of front pad section 206 via fourth secondary air bridge channel 232. Secondary side bellows chamber 224 of side pad section 208H is also in fluid communication with a secondary side bellows chamber 256 associated with side pad section 208G via an eighth secondary air bridge channel 258. A pair of elongated baffle projections 259 extend into secondary side bellows chamber 256 so as to establish a labyrinth type air flow pattern therein. A secondary air charge hole 260 extends through side pad section 208G to permit ambient air to communicate with secondary side bellows chamber 256.

A ninth secondary air bridge channel 262 provides fluid communication between secondary side bellows chamber 256 of side pad section 208G and a secondary side bellows chamber 264 associated with side pad section 208F. A pair of elongated baffle projections 265 extend into secondary side bellows chamber 264 and establish a labyrinth type air flow pattern therein. A secondary air charge hole 266 extends through side pad section 108F to permit ambient air to communicate with secondary side bellows chamber 264. A tenth secondary air bridge channel 268 provides fluid communication between secondary side bellows chamber 264 of side pad section 208F and a secondary side bellows chamber 270 associated with side pad section 208E. Baffle projections 269 extend into secondary side bellows chamber 270 to establish a labyrinth type air flow pattern therein. A secondary air charge hole 272 extends through side pad section 208E to permit ambient air to communicate with secondary side bellows chamber 270.

Right ear pad section 210A of secondary bellows unit 200 defines a secondary ear bellows chamber 274 having one or more elongated baffle projections 275 for establishing a labyrinth type air flow pattern therein. Secondary ear bellows chamber 274 of ear pad section 210A is in fluid communication with secondary side bellows chamber 240 of side pad section 208B via an eleventh secondary air bridge channel 276. A secondary air charge hole 272 extends through ear pad section 210A to permit ambient air to communicate with secondary ear bellows chamber 274. Similarly, left ear pad section 210B of secondary bellows unit 200 defines a secondary ear bellows chamber 278 having one or more elongated baffle projections 279 for establishing a labyrinth type air flow pattern therein. Secondary ear bellows chamber 278 of left ear pad section 210B is in fluid communication with secondary side bellows chamber 256 of side pad section 208G via a twelfth secondary air bridge channel 280. A secondary air charge hole 281 extends through ear pad section 210B to permit ambient air to communicate with secondary ear bellows chamber 178.

Upon installation of CAD assembly 14 into outer shell 12, back pad sections 212A-212D of secondary bellows unit 200 are aligned and positioned adjacent to a back region of helmet 10. Upper back pad sections 212A and 212C are located above lower back pad sections 212B and 212D, respectively. Upper back pad section 212A defines a first secondary upper back bellows chamber 282 that is in fluid communication with secondary side bellows chamber 220 of side pad section 208D via a thirteenth secondary air bridge channel 284. A pair of transversely oriented elongated baffle projections 285 extend into first secondary upper back bellows chamber 282 and are arranged to establish a non-laminar air flow pattern therein. A secondary air charge hole 286 extends through upper back pad section 212A to permit ambient air to communicate with first secondary upper back bellows chamber 282. First secondary upper back bellows chamber 282 of upper back pad section 212A is in fluid communication with a first secondary lower back bellows chamber 288 associated with back pad section 212B via a fourteenth secondary air bridge channel 290. A pair of transversely oriented elongated baffle projections 291 extend into first secondary lower back bellows chamber 288 and are arranged to establish a non-laminar air flow pattern therein. A secondary air charge hole 292 extends through lower back pad section 212B to permit ambient air to communicate with first secondary lower back bellows chamber 288.

Similarly, upper back pad section 212C defines a second secondary upper back bellows chamber 294 that is in fluid communication with secondary side bellows chamber 270 of side pad section 208E via a fifteenth secondary air bridge channel 295. A pair of transversely oriented elongated baffle projections 293 extend into second secondary upper back bellows chamber 294 and are arranged to establish a non-laminar flow pattern therein. A secondary air charge hole 296 extends through upper back pad section 212C to permit ambient air to communicate with second secondary upper back bellows chamber 294. Second secondary upper back bellows chamber 294 of upper back pad section 212C is in fluid communication with a second secondary lower back bellows chamber 298 associated with lower back pad section 212D via a sixteenth secondary air bridge channel 297. A pair of transversely oriented elongated baffle projections 299 are arranged to establish a non-laminar air flow pattern within second secondary lower back bellows chamber 298. A secondary air charge hole 287 extends through lower back pad section 212D to permit ambient air to communicate with second secondary lower back bellows chamber 298.

As described above, secondary bellows unit 200 of CAD assembly 14 includes a plurality of secondary bellows chambers that are each in fluid communication with at least one other secondary bellows chamber via a secondary air bridge channel. When mounting surface 201 of base section 202 is attached to inner surface 308 of inner shell liner 300, the secondary bellows chambers and the secondary air bridge channels define a secondary air flow circuit. While each of the secondary air charge holes is noted to facilitate transfer of ambient air into and out of each of the secondary bellows chambers, they also function to permit the release of moisture or condensation therefrom.

As noted, each of the primary bellows chambers is in fluid communication with a corresponding one of the secondary bellows chambers via an air transfer hole extending through the inner shell liner 300. FIGS. 6, 7, 11, 13 and 14 illustrate many of these air transfer holes. Air transfer holes 310 provide fluid communication between the aligned primary crown bellows chamber and the secondary crown bellows chamber. Similarly, air transfer holes 312 provide fluid communication between aligned sets of primary side bellows chambers and secondary side bellows chambers. Air transfer holes 314A, 314B provide fluid communication between the upper and lower aligned sets of primary back bellows chambers and secondary back bellows chambers, respectively. Finally, air transfer holes 316 provide fluid communication between the aligned sets of primary ear bellows chambers and the secondary ear bellows chambers. Inner shell liner 300 is preferably made of a material having sufficient rigidity to support primary bellows unit 100 and secondary bellows unit 200, and yet have a hardness less than outer shell 12. One example of a suitable material for inner shell liner 300 may include a more dense or stiffer blend of the same material used for the primary and secondary bellows units (i.e., TPE or TPU). Most importantly, inner shell 300 must be more rigid than the first stage and second stage pad sections so as to permit a plurality of pad sections to compress at a time and assist in spreading the energy over a larger area.

Figure 5:
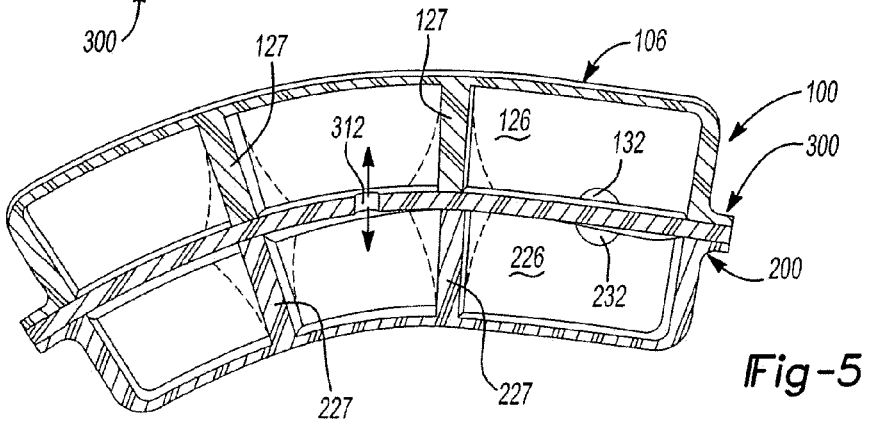
FIG. 5 is a sectional view taken generally along line A-A of FIG. 4.
Figure 6:
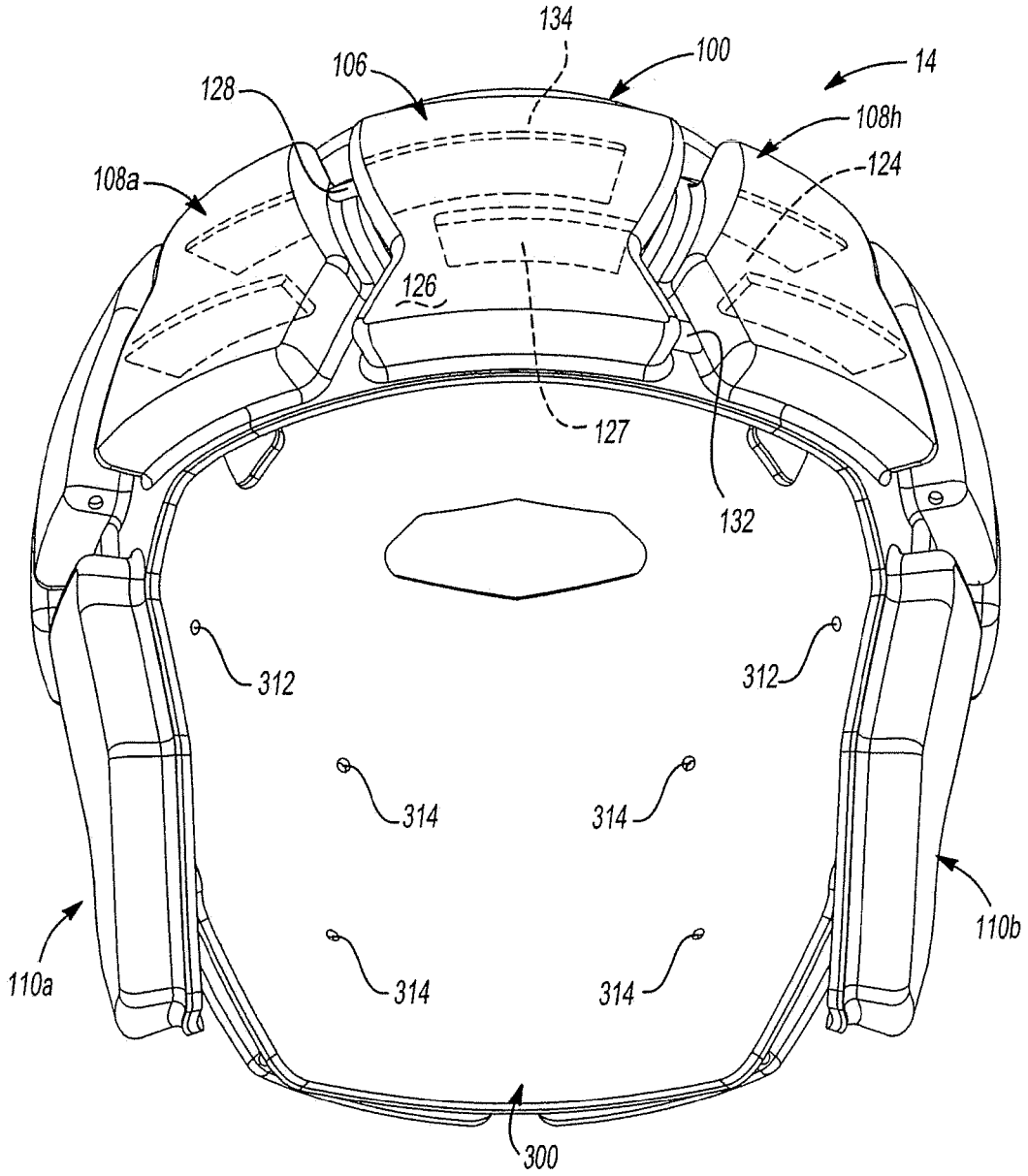
FIG. 6 is generally similar to FIG. 4 except that the secondary bellows unit has been removed for purposes of additional clarity regarding various features of the CAD assembly.
Figure 7:
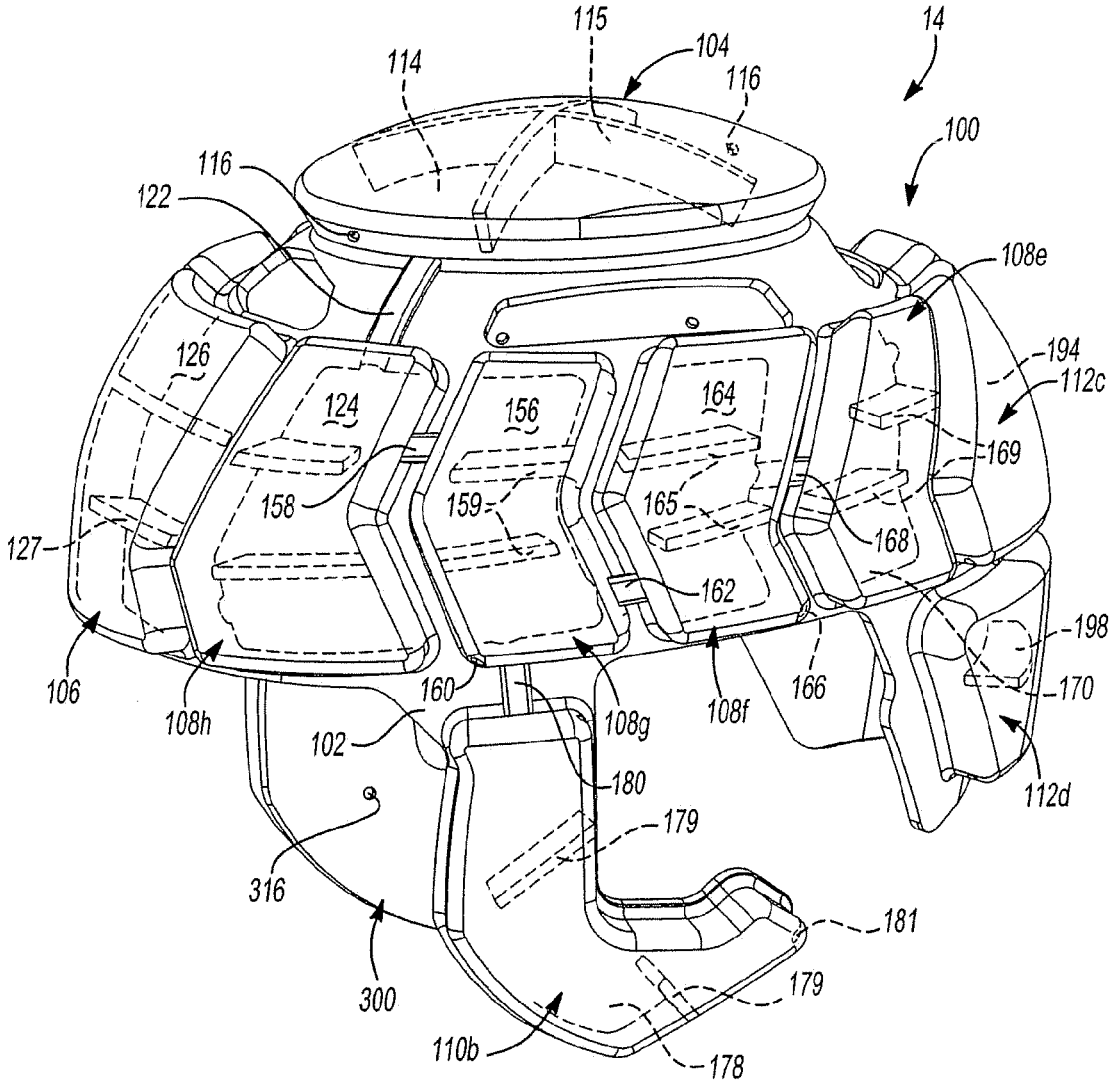
FIG. 7 is a side isometric view of the CAD assembly shown in FIG. 6.
Figure 8:
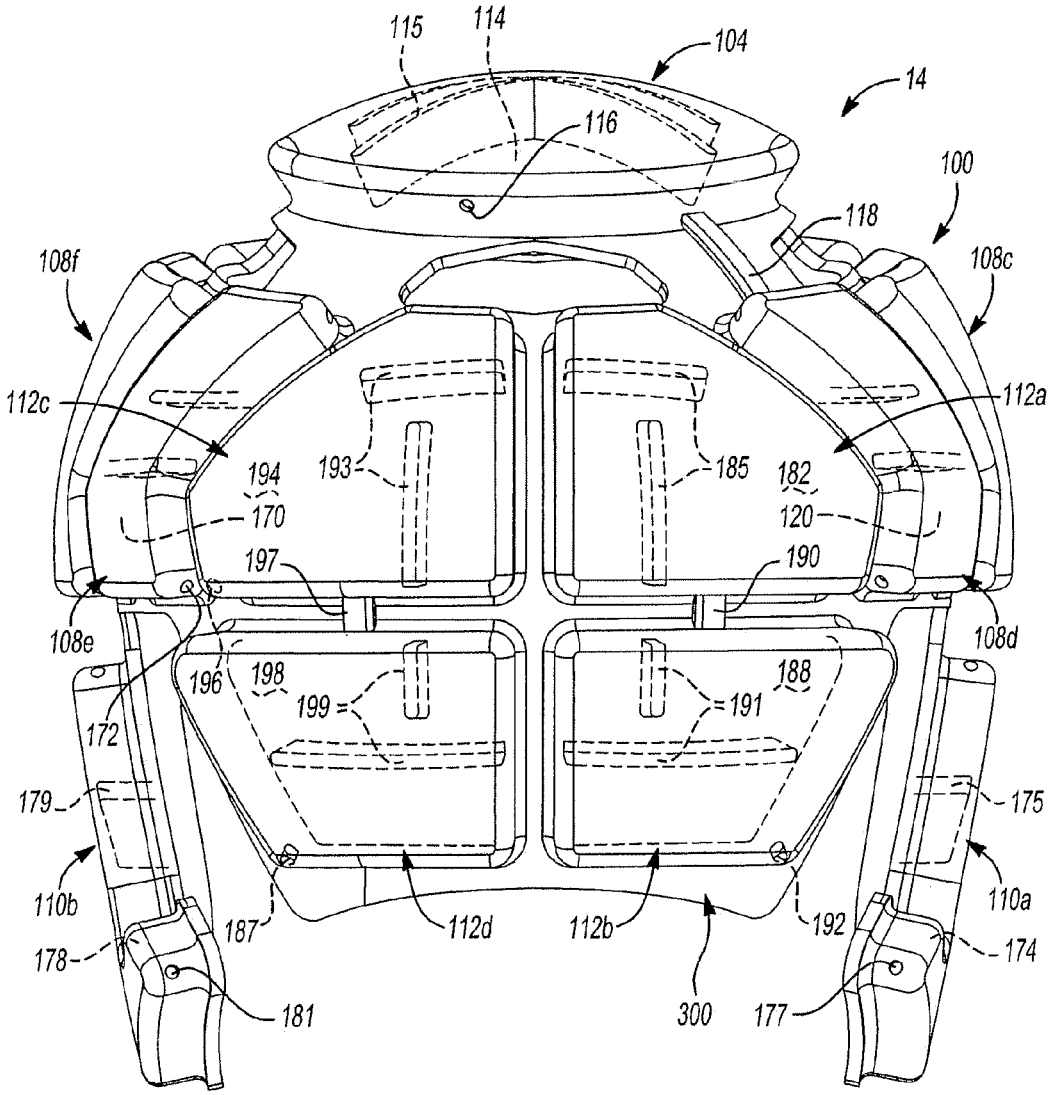
FIG. 8 is a rear isometric view of the CAD assembly shown in FIGS. 6 and 7.
Figure 9:
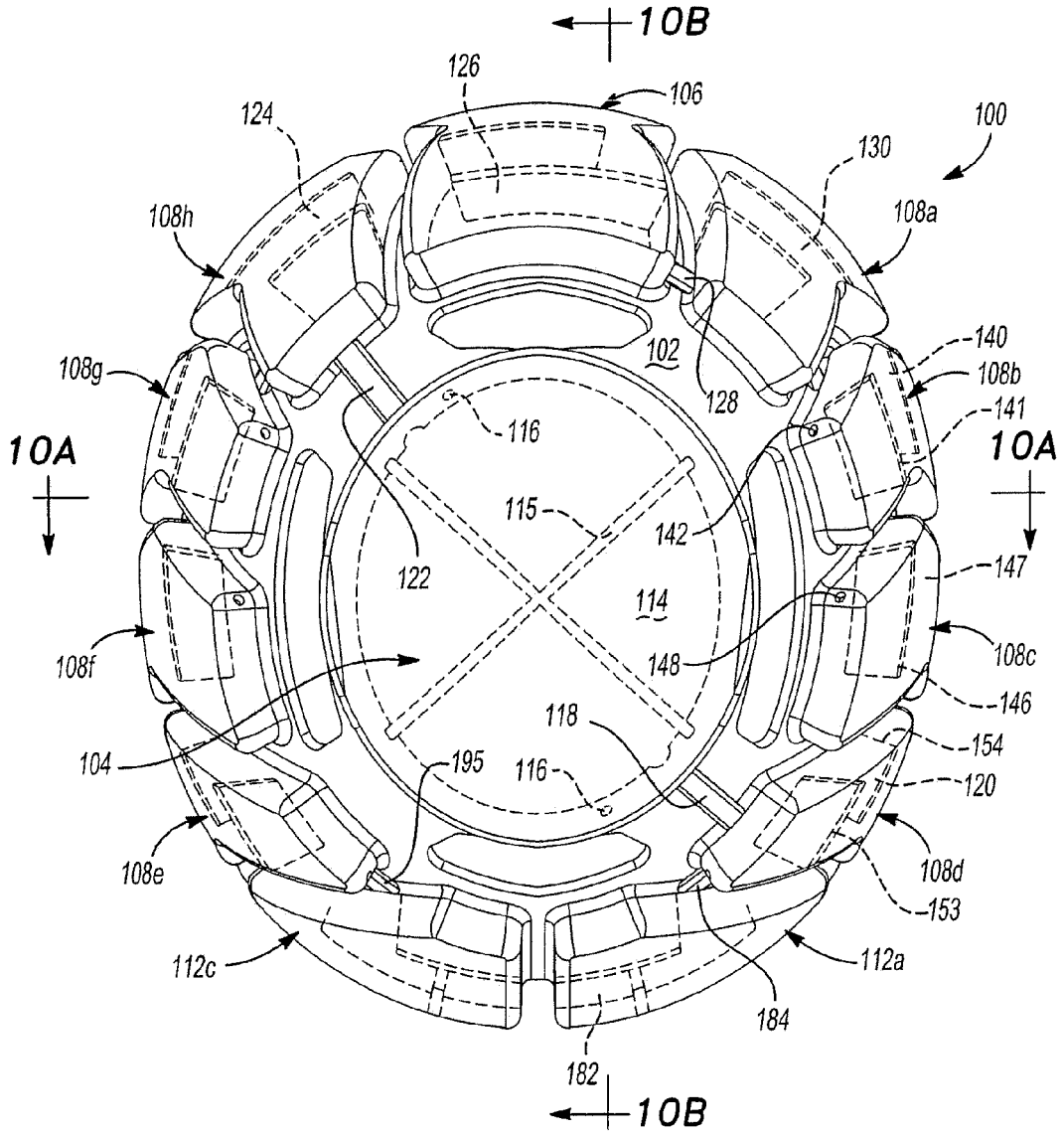
FIG. 9 is a top isometric view of the CAD assembly shown in FIGS. 6 through 8.
Figure 10A:
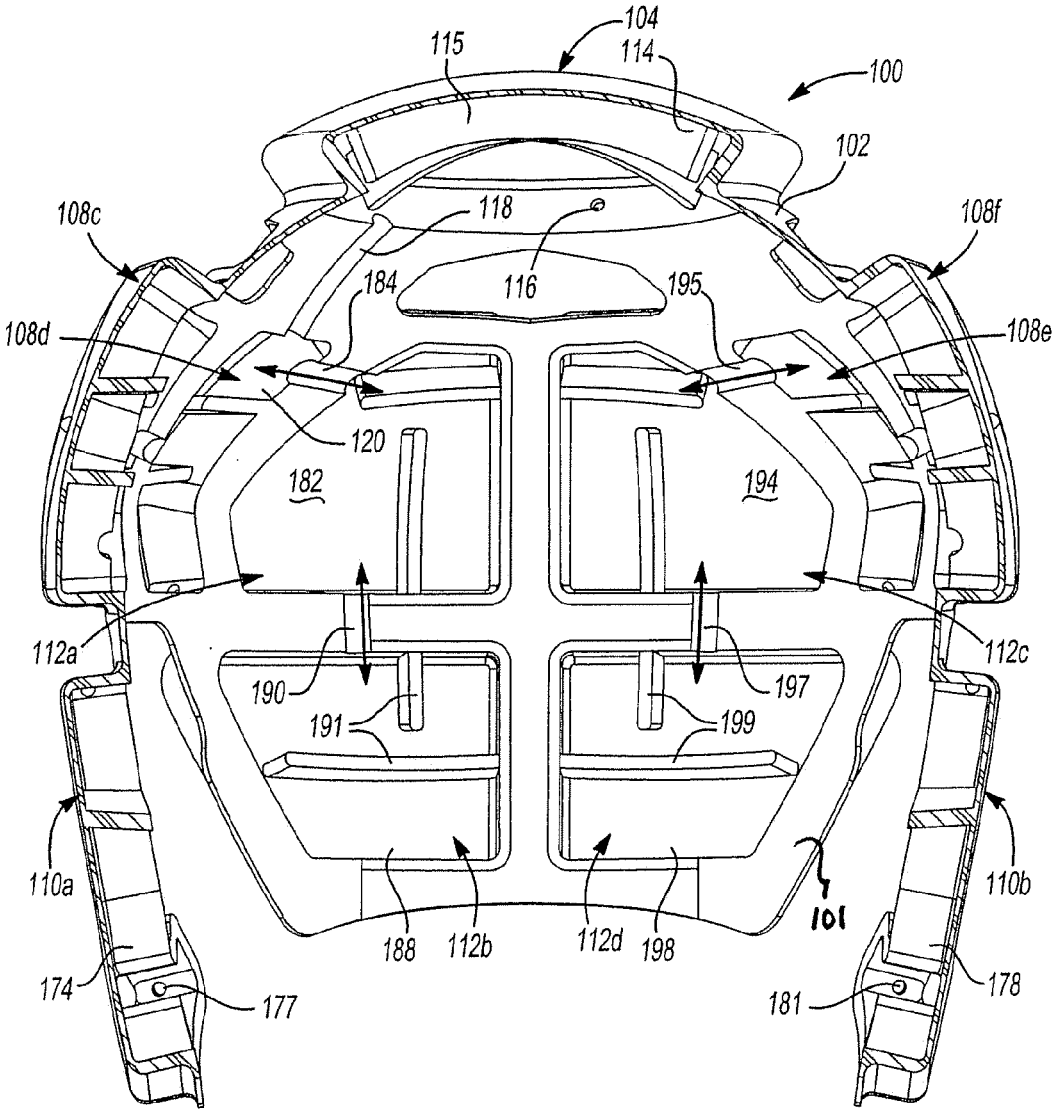
FIGS. 10A and 10B are vertical sectional views of the primary bellows unit associated with the CAD assembly of the present disclosure.
Figure 10B:
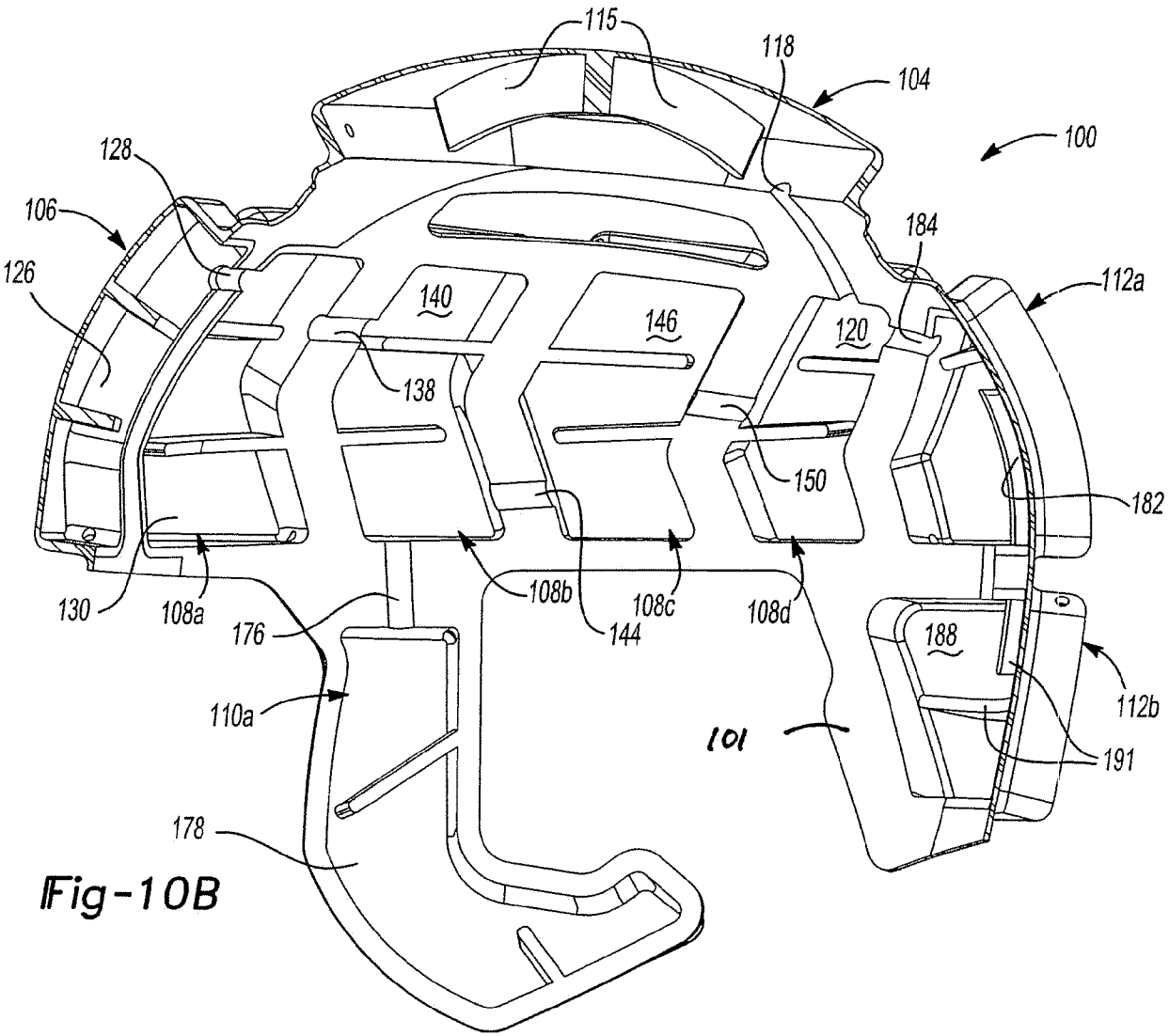
Figure 11A:
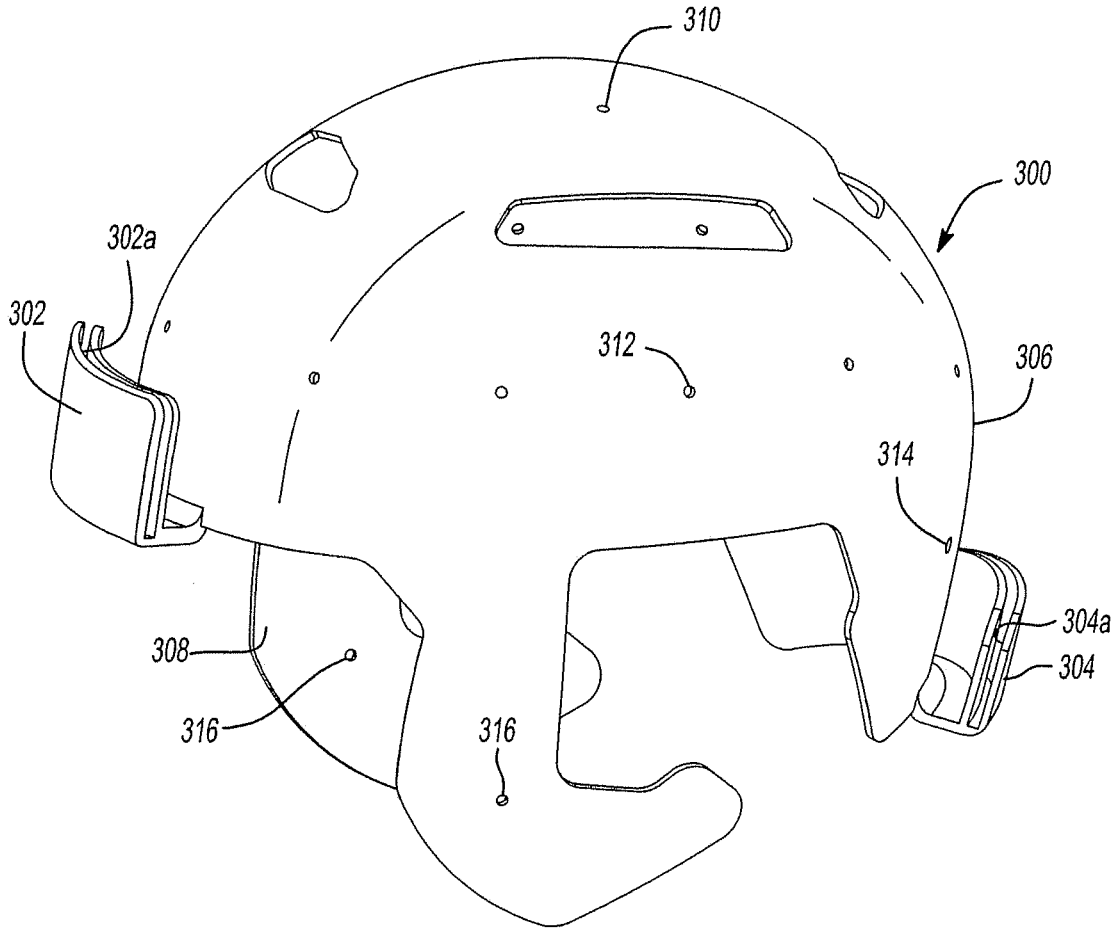
FIGS. 11A and 11B are views of the inner shell liner associated with the CAD assembly of the present disclosure.
Figure 11B:
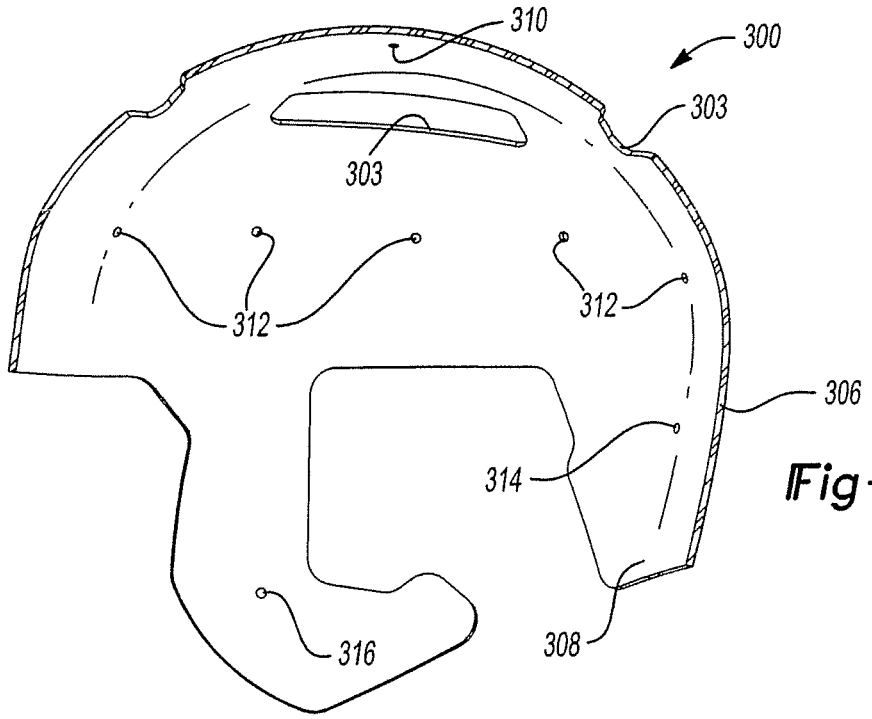
Figure 12:
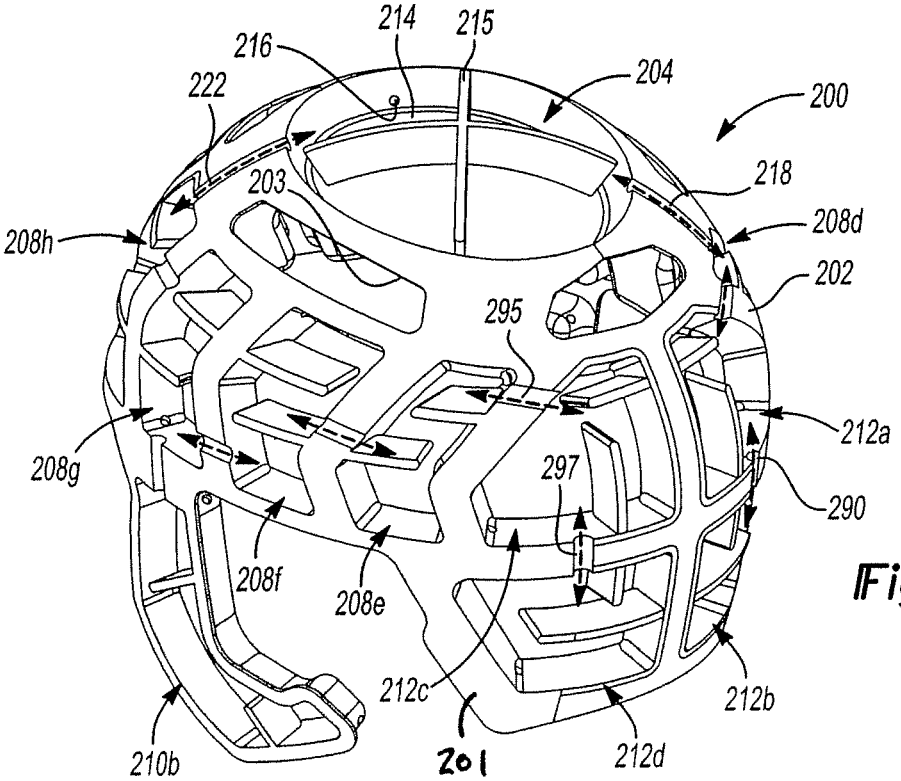
FIG. 12 is an isometric view of the secondary bellows unit associated with the CAD assembly of the present disclosure.
Figure 13:
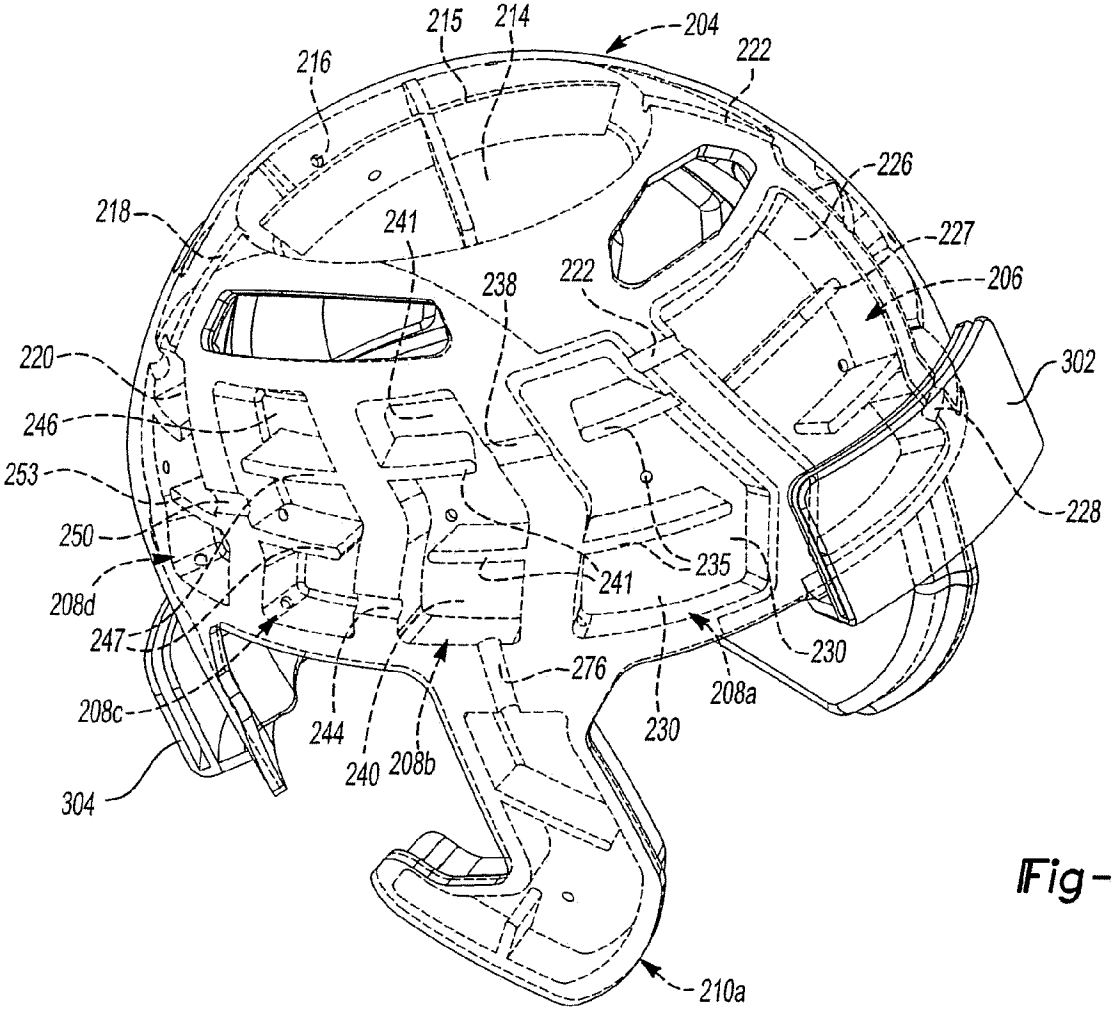
FIG. 13 is a side isometric view of the secondary bellows unit installed in the inner shell liner, which is shown in phantom for improved clarity of the illustration.
Figure 14:
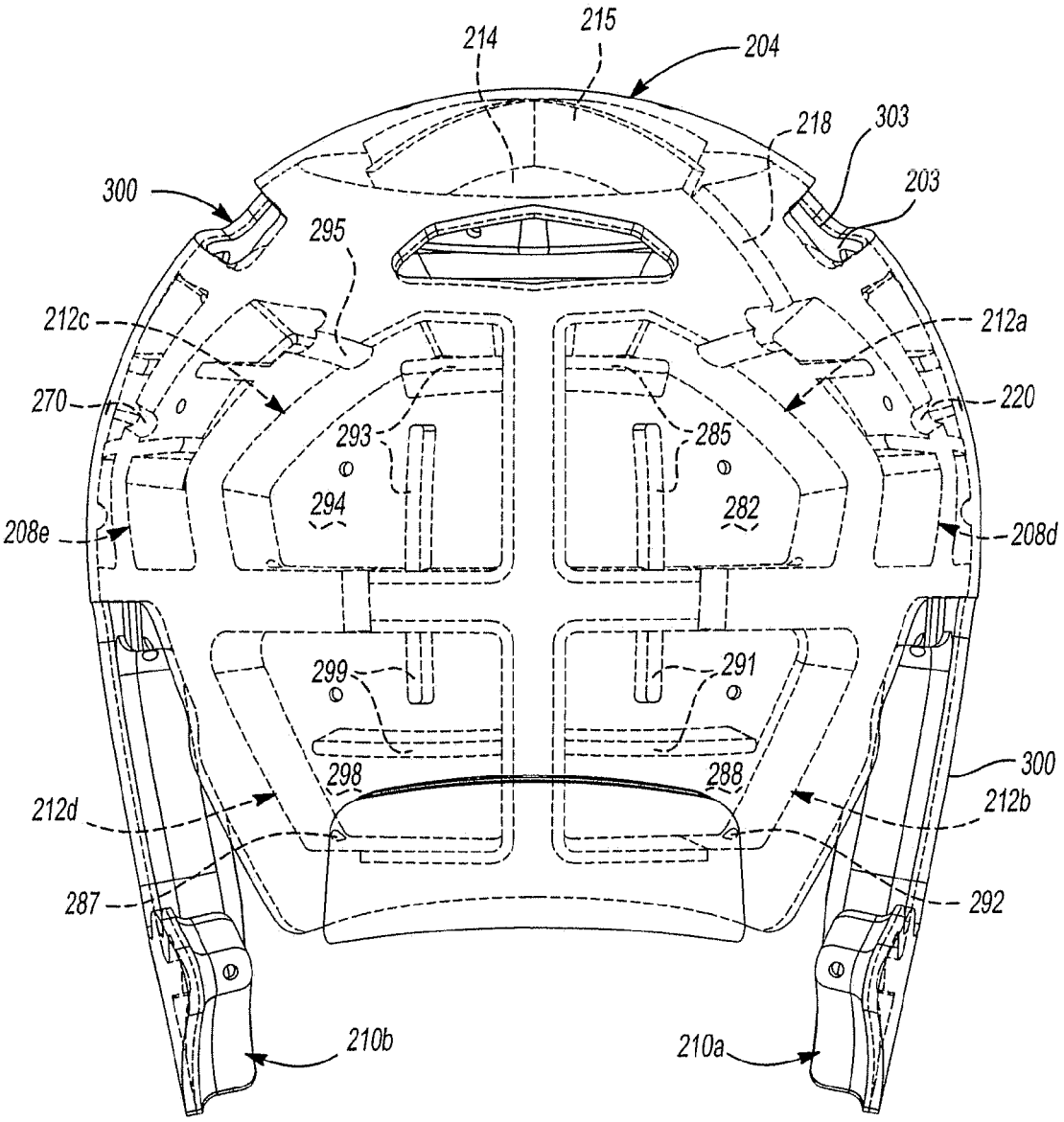
FIG. 14 is a rear isometric view of the secondary bellows unit and inner shell liner shown in FIG. 13.
Figure 15:
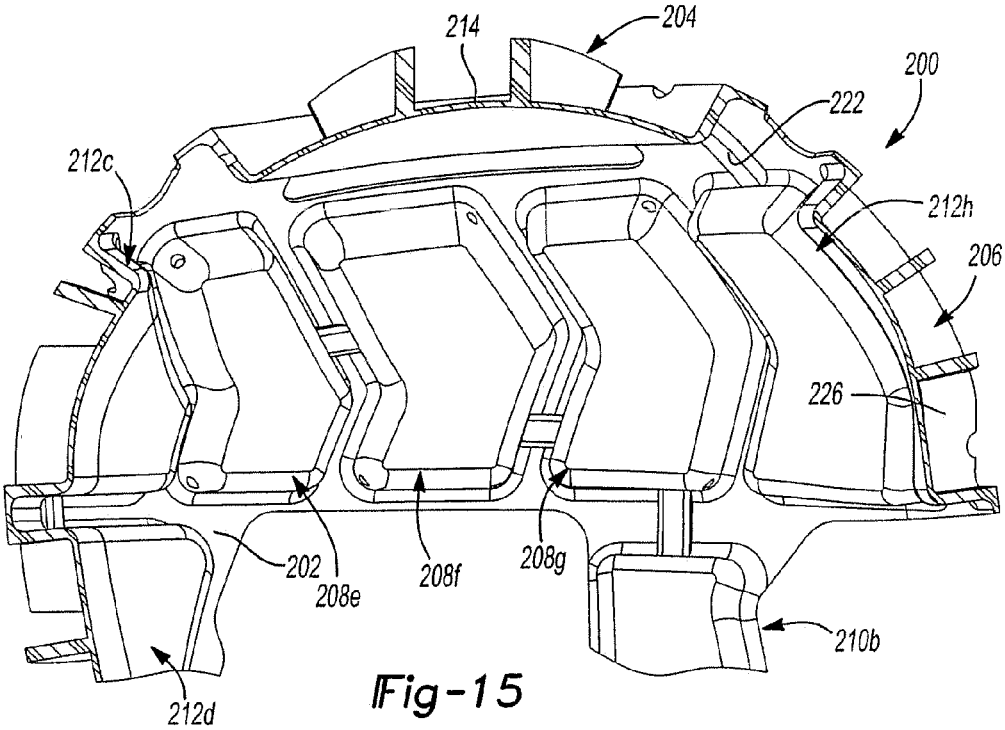
FIG. 15 is a sectional view taken through a portion of the secondary bellows unit.
Figure 16:
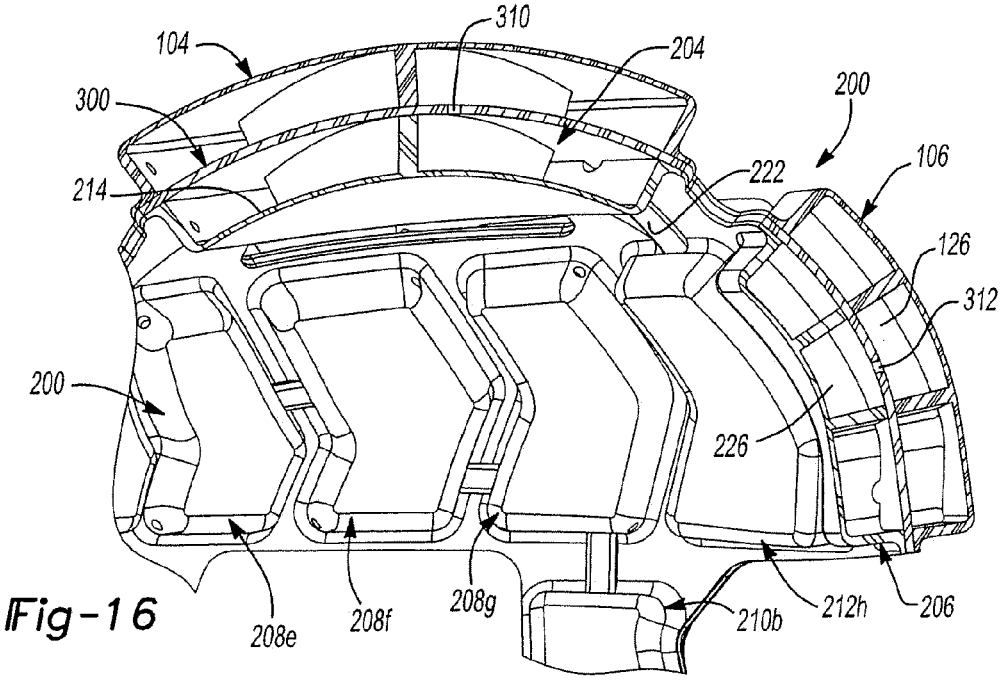
FIG. 16 is a sectional view taken through a portion of the CAD assembly.

Referring to FIG. 5, baffle projections 127 associated with first stage front pad section 106 and baffle projections 227 associate with second stage front pad section 206 are shown to have a generally common "thickness" dimension across their entire height and length. While such common or "straight" baffle projections are acceptable, it has been determined that use of "variable" thickness projections may be useful in controlling the deflection characteristic of the first and second stage pad sections. Accordingly, FIG. 5 illustrates tapered thickness profiles (in phantom) of baffles 127 and 227. Specifically, baffles 127, 227 have a greater thickness dimension near their interface with outer shell liner 300. Such a tapered configuration may permit the pad sections to start collapsing at the surfaces engaging outer shell 10 and the wearer's head, while resisting/attenuating the linear and rotational impact forces.

According to the present disclosure, CAD assembly 14 provides a first stage air transfer and energy dissipation mechanism in association with primary bellows unit 100 as well as a second stage air transfer and energy dissipation mechanism in association with secondary bellows unit 200. In this regard, the primary air flow circuit of primary bellows unit 100 and the secondary air flow circuit of secondary bellows unit 200 facilitate this dual stage air transfer and energy dissipation system. The first and second air flow circuits are interconnected via the air transfer holes formed in inner shell liner 300. Those skilled in the art will appreciate that the specific number, arrangement, size and configuration of the first stage pads (and corresponding primary bellows chambers) and specific number, arrangement, size and configuration of the second stage pads (and corresponding secondary bellows chambers) shown are merely intended to be exemplary in nature. Likewise, the size and air flow characteristics associated with the air charge holes, the air bridge channels, and the air transfer holes can be selected to provide metered and controlled air transfer through CAD assembly 14 to assist in optimizing impact damping and energy dissipation.

In operation, compression of CAD assembly 14 occurs when the head of a wearer of protective helmet 10 encounters an impact which forces the head to move in relation to an angle of impact. This action results in resilient collapse of the pad sections and forces a resilient cushion of regulated and controlled ambient air to be transferred to adjacent bellows chambers, thereby distributing the impact force over a larger area so as to delay and dissipate the impact away from the head of the helmet wearer. CAD assembly 14 creates a multi-stage "time delayed" impact dissipation that is operable for continuously transferring air by filling and subsequently refilling the bellows chambers until the impact has been dispersed.

Referring to FIGS. 17A and 17B, the movement of CAD assembly 14 during, or in response to, a rotational force/acceleration impact exerted on protective helmet 10 is addressed. While linearly directed forces/accelerations of CAD assembly 14 are addressed above, the present disclosure provides a further benefit when helmet 10 is exposed to a rotational impact. Much like a boxer getting hit with a hook, the head of a person wearing helmet 10 can twist. Such rotational and centrifugal movement of the head within helmet 10 is minimized due to CAD assembly 14 providing a "suspended" function due to the elasticity of the stage one and stage two pad sections associated with outer bellows unit 100 and inner bellows unit 200 relative to inner shell liner 300. An example of angular movement of CAD assembly 14 relative to the wearer's head is shown by alpha "a" in FIG. 17B. Accordingly, compression of adjacent pad sections in concert with elastic deflection thereof, functions to limit the intensity of a rotational force exerted on outer shell 12 of helmet 10.

CAD assembly 14 can be a modular assembly that can be easily installed in, or removed from virtually any type of outer shell portion of a helmet. This modularity permits different impact damping characteristics to be established by simply selecting from one or more differently sized or configured primary bellows unit 100, secondary bellows units 200 and inner shell liners 300 to provide optimal comfort and address both adult and youth requirements.

As noted, primary bellows unit 100 and secondary bellows unit 200 of CAD assembly 14 are configured and arranged to each be rigidly secured to a corresponding surface of inner shell liner 300 in an "air-tight" manner to facilitate the impact dissipation and load transfer characteristic provided by the dual-stage air dissipation technology of the present disclosure. Specifically, mounting surface 101 of primary base section 102 on primary bellows unit 100 is configured and arranged to be secured in this air-tight manner with respect to outer surface 306 of inner shell liner 300. Likewise, mounting surface 201 of secondary base section 202 on secondary bellows unit 200 is configured and arranged to be secured in this air-tight manner with respect to inner surface 306 of inner shell liner 300. In these arrangements, the term "air-tight" is intended to describe and define a sealed relationship between adjacent first stage pad sections and inner shell liner 300 to establish the primary air flow circuit as well as a sealed relationship between adjacent second stage pad sections and inner shell liner 300 to establish the secondary air flow circuit. To this end, air transfer between adjacent primary bellows chambers is provided via the primary air bridge channels while air transfer between adjacent secondary bellows chambers is provided via the secondary air bridge channels.

To provide such a sealed relationship between the components of CAD assembly 14, it is contemplated that attachment zones are established around and between adjacent first stage pad sections as well as around and between adjacent second stage pad sections with respect to inner shell liner 300 via an adhesive bonding or a thermal bonding (i.e. welding) process. One preferred thermal bonding process includes ultra-sonic welding which functions to melt and fuse the thermoplastic and/or TPU components of CAD assembly 14 together along the defined attachment zones. Those skilled in the art will recognize, based on this description and the detailed drawings provided for CAD assembly 14, that the base section of each of primary bellows unit 100 and secondary bellows unit 200 is configured to provide adequate clearance dimensions between adjacent raised pad sections to accommodate the tooling associated with ultra-sonic welding operations. While ultra-sonic welding is described as a potentially preferred thermal bonding process for CAD assembly 14, the present disclosure is intended to encompass and include any suitable adhesive, mechanical or thermal process or technique for rigidly securing primary bellows unit 100 and secondary bellows unit 200 to inner shell liner 300.

As also noted, CAD assembly 14 shown in FIGS. 2-16 includes primary bellows unit 100 and secondary bellows unit 200 each having a pad component fabricated as a one-piece molded component. Upon sealed attachment to corresponding surfaces of inner shell liner 300, each of primary bellows unit 100 and secondary bellows unit 200 define a series of fluidically interconnected primary and secondary bellows chambers. As an alternative to the one-piece molded pad components, it is a viable option to provide a series of primary bellows sub-units and secondary bellows sub-units, each of which is configured to be bonded to inner shell liner 300 and fluidically interconnected via attached air bridge channels of independent transfer conduits.

The use of separate primary and secondary bellows sub-units provides CAD assembly 14 with a "modularity" feature which may facilitate improved optimization of the dual-stage air dissipation technology. For example, it is possible to provide a first primary bellows sub-unit in association with a crown pad section (i.e. crown pad section 104), a second primary bellows subunit in association with a front pad section (i.e. front pad section 106), a third primary bellows sub-unit in association with rear pad sections (i.e. rear pad sections 112A-112D), a fourth primary bellows sub-unit in association with the left side pad sections and ear pad section (i.e. side pad sections 108A-108D and ear pad section 110A), and a fifth primary bellows sub-unit in association with the right side pad sections and ear pad section (i.e. side pad sections 108E-108H and ear pad section 110B). Each of these five primary bellows sub-units would be in fluid communication with at least one other primary bellows sub-unit to establish the primary air flow circuit. In addition, each of these primary bellows sub-units would be rigidly secured in an airtight manner relative to corresponding portions of outer surface 306 of inner shell liner 300. Obviously, a like number of secondary bellows sub-units would be rigidly secured to inner surface 308 of inner shell liner 300 and fluidically interconnected to establish the secondary air flow circuit. Each of the primary and secondary bellows sub-units would be fabricated as a one-piece pad component. These pad components could include extension segments formed integrally with the base segment and which contain the air bridge channels configured to fluidically interconnect adjacent bellows chambers. Optionally, separate extension segments can be provided to interconnect the adjacent pad components. The particular number, size and configuration of the primary bellows sub-units and the secondary bellows sub-units can be varied to provide CAD assembly 14 for use in protective helmet 10.

Up to this point, CAD assembly 14 has been described to include a common inner shell liner 300 to which one-piece primary and secondary bellows units 100, 200 are attached or to which a plurality of primary and secondary bellows subunits are attached. The present disclosure, however, further contemplates a protective helmet 10 having a plurality of distinct CAD pad assemblies that are adapted for direct attachment to inner surface 20 of outer shell 12. To this end, FIGS. 18-25 illustrate an exemplary independent or "standalone" CAD pad assembly 14' that is generally comprised of a primary or outer pad component 400, a secondary or inner pad component 500, and an inner liner plate 600 disposed between primary pad component 400 and secondary pad component 500. Primary pad component 400 is shown to include a plurality of first stage pad sections each defining a primary bellows chamber in cooperation with liner plate 600 and which is in fluid communication with at least one other adjacent primary bellows chamber. A primary air charge hole permits ambient air to communicate with at least one of the primary bellows chambers. Likewise, secondary pad component 500 is shown to include a plurality of second stage pad sections each defining a secondary bellows chamber in cooperation with liner plate 600 and which is in fluid communication with at least one other adjacent secondary bellows chamber. A secondary air charge hole permits ambient air to communicate with at least one of the secondary bellows chambers. Liner plate 600 includes at least one air transfer hole that facilitates the transfer of air between a pair of aligned primary and secondary bellows chambers. An outer surface of each of the first stage pad sections may be configured for removable attachment to inner surface 20 of outer shell 12 via suitable fasteners such as, for example, VELCRO or snaps. Similarly, an outer surface of each of the second stage pad sections is configured to engage or be in close proximity to the head of a person wearing protective helmet 10. Accordingly, CAD pad assembly 14' is configured to define a dual-stage air dissipation system which, upon an impact force being applied to outer shell 12, facilitates: A) the transfer of air between adjacent primary bellows chambers and the discharge of air from the at least one primary air charge hole; B) the transfer of air between adjacent secondary bellows chambers and the discharge of air from the at least one secondary air charge hole; and C) the transfer of air between the aligned set of primary and secondary bellows chambers via the at least one air transfer hole in liner plate 600.

With particular reference to FIGS. 18-20 and 23, primary pad component 400 of CAD pad assembly 14' is shown to include a plurality of eight first stage or primary pad sections 402A-402H extending outwardly from a primary base section 404 having a mounting surface 406 that is adapted to be secured in an air-tight manner to a first or outer surface 602 of liner plate 600. Those skilled in the art will recognize that the number, size and/or shape of the primary pad sections can be varied from the exemplary construction shown. Since first stage pad sections 402A-402H are normally filled with non-pressurized air, they are configured to deflect in response to an impact load. Primary pad component 400 is preferably a one-piece molded component fabricated from a semi-rigid, yet resilient material such as, for example TPU, TPE or a blended thermal elastomer.

A first primary air bridge channel 408 is formed in base section 404 and interconnects a first primary bellows chamber 410 associated with primary pad section 402A for fluid communication with a second primary bellows chamber 412 associated with primary pad section 402B. A second primary air bridge channel 414 is formed in base section 404 and interconnects second primary bellows chamber 412 for fluid communication with a third primary bellows chamber 416 associated with primary pad section 402C. A third primary air bridge channel 418 is formed in base section 404 and interconnects third primary bellows chamber 416 for fluid communication with a fourth primary bellows chamber 420 associated with primary pad section 402D. A transversely-extending fourth primary air bridge channel 422 is formed in base section 404 and interconnects fourth primary bellows chamber 420 for fluid communication with a fifth primary bellows chamber 424 associated with primary pad section 402E. A fifth primary air bridge channel 426 is formed in base section 404 and interconnects fifth primary bellows chamber 424 for fluid communication with a sixth primary bellows chamber 428 associated with primary pad section 402F. A sixth primary air bridge channel 430 is formed in base section 404 and interconnects sixth primary bellows chamber 428 for fluid communication with a seventh primary bellows chamber 432 associated with primary pad section 402G. Finally, a seventh primary air bridge channel 434 is formed in base section 404 and interconnects seventh primary bellows chamber 432 for fluid communication with an eighth primary bellows chamber 436 associated with primary pad section 402H. A primary air charge hole 438 is formed in primary pad section 402H to permit ambient air to enter/exhaust eighth primary bellows chamber 436 which, in turn, communicates with the other seven primary bellows chambers via the primary air bridge channels. The volume of each bellows chamber as well as the flow characteristics associated with the primary air bridge channels and the primary air charge hole can be varied from that shown to provide optimized air dissipation for a particular application.

Primary pad component 400 is shown to be generally symmetrical with respect to a longitudinal plane as well as with respect to a central lateral plane. Base section 404 is shown to define a continuous peripheral flange portion 440, a longitudinal web portion 442 interconnected at its opposite ends to flange portion 440, and a plurality of transverse web portions 444A, 444B and 444C also interconnected at their opposite ends to flange portion 440. As seen, primary air bridge channels 408 and 434 are formed in web portion 444A, primary air bridge channels 414 and 430 are formed in web portion 444B, primary air bridge channels 418 and 426 are formed in web portion 444C and primary air bridge channel 422 is formed in web portion 442 of base section 404. The width and thickness dimensions for continuous flange portion 440, longitudinal web portion 442 and lateral web portions 444A-C are selected to facilitate air-tight sealed weld seams or attachment zones upon primary pad component 400 being bonded (i.e. thermally and/or adhesively) to first surface 602 of liner plate 600.

A pair of locator posts 450 are shown to extend outwardly from mounting surface 406 of base section 404 and are sized and positioned for receipt in locator apertures 604 formed into or through liner plate 600. The use of locator posts 450 and locator apertures 604 assists in positioning primary pad component 400 relative to liner plate 600 during assembly. While not shown, it is contemplated that posts 450 could also extend into locator ports formed in secondary pad component 500 to provide further assistance in aligning all three components of CAD pad assembly 14'.

Secondary pad component 500 of CAD pad assembly 14' is shown to include a plurality of eight second stage or secondary pad sections 502A-502H extending outwardly from a secondary base section 504 having a mounting surface 506 that is adapted to be secured in an air-tight manner to a second or inner surface 606 of liner plate 600. Those skilled in the art will appreciate that the specific number, size and/or shape of the secondary pad sections can be varied from the exemplary construction shown. It will be noted that construction of secondary pad component 500 is virtually identical to that of primary pad component 400. Since second stage pad sections 502A-502H are normally filled with non-pressurized air, they are configured to deflect in response to an impact load. Secondary pad component 500 may be made as a one-piece molded component fabricated from a semi-rigid, yet resilient material such as, for example, TPU, TPE or a blended thermal elastomer.

A first secondary air bridge channel 508 is formed in base section 504 and interconnects a first secondary bellows chamber 510 associated with secondary pad section 502A with a second secondary bellows chamber 512 associated with secondary pad section 502B. A second secondary air bridge channel 514 is formed in base section 504 and interconnects second secondary bellows chamber 512 for fluid communication with a third secondary bellows chamber 516 associated with secondary pad section 502C. A third secondary air bridge channel 518 is formed in base section 504 and interconnects third secondary bellows chamber 516 for fluid communication with a fourth secondary bellows chamber 520 associated with secondary pad section 502D. A transversely-extending fourth secondary air bridge channel 522 is formed in base section 504 and interconnects fourth secondary bellows chamber 520 for fluid communication with a fifth secondary bellows chamber 524 associated with secondary pad section 502E. A fifth secondary air bridge channel 526 is formed in base section 504 and interconnects fifth secondary bellows chamber 524 for fluid communication with a sixth secondary bellows chamber 528 associated with secondary pad section 502F. A sixth secondary air bridge channel 530 is formed in base section 504 and interconnects sixth secondary bellows chamber 528 for fluid communication with a seventh secondary bellows chamber 532 associated with secondary pad section 502G. Finally, a seventh secondary air bridge channel 534 is formed in base section 504 and interconnects seventh secondary bellows chamber 532 for fluid communication with an eighth secondary bellows chamber 536 associated with secondary pad section 502H. A secondary air charge hole 538 is formed in secondary pad section 502A to permit ambient air to enter/exhaust from first secondary bellows chamber 510 which, in turn, communicates with the other seven secondary bellows chambers via the secondary air bridge channels.

Secondary pad component 500 is shown to be generally symmetrical with respect to a longitudinal plane as well as with respect to a central lateral plane. Base section 504 is shown to include a continuous flange portion 540, a longitudinal web portion 542 and a plurality of transverse web portions 544A, 544B, 544C. As seen, secondary air bridge channels 508 and 534 are formed in web portion 544A, secondary air bridge channels 514 and 530 are formed in web portion 544B, secondary air bridge channels 518 and 526 are formed in web portion 544C, and secondary air bridge channel 522 is formed in web portion 542 of base section 504. The width and thickness dimensions for flange portion 540, longitudinal web portion 542 and lateral web portions 544A-544C are selected to facilitate air-tight sealed weld seams or attachment zones upon secondary pad component 500 being securely bonded (i.e. thermally and/or adhesively) to second surface 606 of liner plate 600.

Liner plate 600 is shown to include a generally constant plate thickness defining first mounting surface 602 and second mounting surface 606. As noted, first mounting surface 602 of liner plate 600 is adapted to be secured to surface 406 of primary base section 404 associated with primary pad component 400 while second mounting surface 606 of liner plate 600 is adapted to be secured to surface 506 of secondary base section 504 associated with secondary pad component 500. Liner plate 600 is preferably fabricated as a molded or stamped component having a more dense or stiffer blend of the same material used for the primary and secondary pad components such that it is more rigid in structure than the first and second stage pad sections. Liner plate 600 is shown to include a pair of air transfer holes 608 and 610. Air transfer hole 608 is positioned to permit air transfer between primary bellows chamber 416 associated with first stage pad section 402C and secondary bellows chamber 516 associated with second stage pad section 502C. Similarly, air transfer hole 610 is positioned to permit air transfer between primary bellows chamber 428 associated with first stage pad section 402F and secondary bellows chamber 528 associated with second stage pad section 502F. It will be appreciated that the number, location and size of the air holes formed through liner plate 600 can be varied to optimize the dual stage air dissipation system for differing helmet applications.

CAD pad assembly 14' can be configured for use in any of the dual-stage pad locations previously disclosed such as, for example, the crown pads, the front pads, the rear pads, the side pads and/or the ear pads. Each CAD pad assembly 14' can be an independent unit installed within outer shell 12 of helmet 10 or, in the alternative, one or more of CAD pad assemblies 14' can be fluidically interconnected to another CAD pad assembly via an air transfer conduit. To illustrate this alternative construction, a primary connector port 452 is shown in phantom lines in FIG. 20 is association with first stage pad section 402B while a secondary connector port 552 is shown in phantom lines in association with second stage pad section 502B. A primary air transfer conduit (not shown) will have a first end inserted into and sealed relative to port 452. A second end of the primary air transfer conduit will be inserted in and sealed relative to another primary connector port associated with a first stage pad section of another CAD pad assembly to establish a primary flow circuit therebetween. Similarly, a secondary air transfer conduit (not shown) will have its first end inserted into and sealed relative to secondary connector port 552 while its second end will be inserted into and sealed relative to another secondary connector port associated with a second stage pad section of another CAD pad assembly.

Referring now to FIGS. 26 through 29, an alternative version of CAD pad assembly 14' is shown and identified by reference number 14". For purposes of clarity and convenience, similar components and/or features will be identified by common reference numbers having a primed suffix. The specific features of CAD pad assembly 14" that are different from CAD pad assembly 14' will be described with greater detail to provide skilled practitioners with a clear understanding thereof. To this end, CAD pad assembly 14" is a non-symmetrical configuration having primary and secondary pad sections of varying width, length and height dimensions that better replicate a pad assembly contemplated for use in a protective helmet.

In addition to the non-symmetrical configuration of the first stage and second stage pad sections, various other structural features are associated with CAD pad assembly 14". Specifically, liner plate 600' provides a non-planar configuration having primary raised portions 620 extending from first surface 602' and secondary raised portions 622 extending from second surface 606'. As best seen in FIGS. 27 and 29, primary raised portions 620 are configured to engage a corresponding Chamfered portion of primary base section 404' such that primary raised portions 620 are generally aligned and seated within corresponding primary bellows chambers. Suffixes A-H are used with primary raised portions 620 in FIG. 27 to provide a direct correlation to the corresponding primary bellows chamber. Similarly, secondary raised portions 622 are configured to engage a corresponding Chamfered portion of secondary base section 504' such that each secondary raised portions 622 is generally aligned and seated within a corresponding one of the secondary bellows chambers. The Chamfered edge of surface 506' surrounding each of the secondary bellows chambers is best shown in FIG. 28 and identified by reference numerals 507A-507H. In addition, lateral web portions 544A', 544B' and 544C' associated with secondary base section 504' are offset from lateral web portions 545A, 545B and 545C. Similarly, offset lateral web portions are associated with primary base section 404' to facilitate mating of primary pad component 400' with liner plate 600' of FIG. 27.

Another variation illustrated in CAD pad assembly 14" is the use of tubular air bridge conduits to fluidically interconnect adjacent primary and/or secondary bellows chambers. FIGS. 26, 28 and 29 illustrate such a secondary air bridge conduit 570 formed in secondary base section 504' and interconnecting fourth secondary bellows chamber 520' associated with second stage pad section 502D' with fifth secondary bellows chamber 524' associated with second stage pad section 502E'. The drawings also illustrate a similar primary air bridge conduit 470 formed in primary base segment 404' and interconnecting fourth primary A bellows chamber 420' associated first stage pad section 402D' with fifth primary bellows chamber 424' associated with first stage pad section 402E'. Another primary air bridge conduit 472 is shown to interconnect primary bellows chamber 428' associated with first stage pad section 402F' with primary bellows chamber 432' associated with first stage pad section 402G'. Accordingly, such tubular bridge conduits can be used in conjunction with, or in substitution for, the semi-cylindrical air bridge channels disclosed in association with CAD assembly 14 and CAD pad assembly 14'.

A method for ultra-sonic welding of the components associated with CAD assembly 14 and/or CAD pad assemblies 14', 14" is now disclosed. The thermoplastic components are assembled and supported in a weld fixture. Specifically, the inner liner/liner plate is oriented and disposed between the primary pad component and the secondary pad component. A metallic (i.e. titanium or aluminum) horn is brought into contact with the upper component. Next, a controlled pressure is applied to the assembled components within the fixture for applying a desired clamping force. The horn is vibrated at a high frequency (i.e. about 20 kHz to 40 kHz) for a predetermined weld time. The mechanical vibrations are transmitted through the plastic materials to the joint interfaces or attachment zones to create frictional heat. This heat causes the joint interface to exceed the material melting temperature such that the plastic melts and flows. The vibratory motion is halted upon the materials reaching the melting temperature. Thereafter, the clamping force is maintained for a predetermined cool down time to allow cooling and solidification of the fused components. After, the clamping force is removed, the horn is also retracted. The ultrasonically welding CAD assembly 14 and/or CAD pad assembly 14', 14" is removed from the fixture.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A protective helmet to be worn on the head of a person, comprising:

a rigid outer shell defining an interior chamber; and a controlled air dissipation (CAD) assembly removably installed within said interior chamber of said outer shell and including an inner shell liner, first and second primary bellows units mounted to a first surface of said inner shell liner, first and second secondary bellows units mounted to a second surface of said inner shell liner, a primary air transfer conduit and a secondary air transfer conduit, said first primary bellows unit including at least two first primary bellows chambers which are fluidically interconnected by a first primary air channel to facilitate air transfer therebetween, said second primary bellows unit including at least two second primary bellows chambers which are fluidically interconnected by a second primary air channel to facilitate air transfer therebetween, said primary air transfer conduit fluidically interconnecting one of said first primary bellows chambers with one of said second primary bellows chambers to facilitate air transfer between said first and second primary bellows units, said first secondary bellows unit including at least two first secondary bellows chambers which are fluidically interconnected by a first secondary air channel to facilitate air transfer therebetween, said second secondary bellows unit including at least two second secondary bellows chambers which are fluidically interconnected by a second secondary air channel to facilitate air transfer therebetween, said secondary air transfer conduit fluidically interconnecting one of said first secondary bellows chambers to one of said second secondary bellows chambers to facilitate air transfer between said first and second secondary bellows units, said inner shell liner including first and second air transfer holes, said first air transfer hole arranged to facilitate air transfer between one of said first primary bellows chambers and one of said first secondary bellows chambers, and said second air transfer hole arranged to facilitate air transfer between one of said second primary bellows chambers and one of said second secondary bellows chambers.

2. The protective helmet of claim 1 wherein said first primary bellows unit includes a first primary base section adapted to be mounted to said first surface of said inner shell liner, a plurality of first primary pad sections extending from said first primary base section and which define said first primary bellows chambers therein, and a plurality of first primary bridge sections formed in said first primary base section which interconnect adjacent first primary pad sections and define said first primary air channels, and wherein said second primary bellows unit includes a second primary base section adapted to be mounted to said first surface of said inner shell liner, a plurality of second primary pad sections extending outwardly from said second primary base section and which define said second primary bellows chambers therein, and a plurality of second primary bridge sections formed in said second primary base section which interconnect adjacent second primary pad sections and define said second primary air channels.

3. The protective helmet of claim 2 wherein at least one of said first primary pad sections includes a first primary air charge hole to permit ambient air to communicate with said interconnected first primary bellows chambers, and wherein at least one of said second primary pad sections includes a second primary air charge hole to permit ambient air to communicate with said interconnected second primary bellows chambers.

4. The protective helmet of claim 3 wherein said first primary base section of said first primary bellows unit is thermally bonded to said first surface of said inner shell liner, and wherein said second primary base section of said second primary bellows unit is thermally bonded to said first surface of said inner shell liner.

5. The protective helmet of claim 4 wherein said primary air transfer conduit is thermally bonded to said first surface of said inner shell liner and defines a primary air passage having a first end fluidically communicating with one of said first primary bellows chambers and a second end fluidically communicating with one of said second primary bellows chambers to thereby establish a primary air flow circuit between said first and second primary bellows units.

6. The protective helmet of claim 1 wherein each of said first primary bellows chambers associated with said first primary bellows unit is aligned with a corresponding one of said first secondary bellows chamber associated with said first secondary bellows unit, and wherein said first air transfer hole is formed in said inner shell liner to facilitate air transfer between said aligned sets of first primary and secondary bellows chambers.

7. The protective helmet of claim 3 wherein said first secondary bellows unit includes a first secondary base section adapted to be mounted to said second surface of said inner shell liner, a plurality of first secondary pad sections extending from said first secondary base section and which define said first secondary bellows chambers therein, and a plurality of first secondary bridge sections formed in said first secondary base section which interconnect adjacent first secondary pad sections and define said first secondary air channels, and wherein said second secondary bellows unit includes a second secondary base section adapted to be mounted to said second surface of said inner shell liner, a plurality of second secondary pad sections extending outwardly from said second secondary base section and which define said second secondary bellows chambers therein, and a plurality of second secondary bridge sections formed in said second secondary base section which interconnect adjacent second secondary pad sections and define said second secondary air channels.

8. The protective helmet of claim 7 wherein at least one of said first secondary pad sections includes a first secondary air charge hole to permit ambient air to communicate with said interconnected first secondary bellows chambers, and wherein at least one of said second secondary pad sections includes a second secondary air charge hole to permit ambient air to communicate with said interconnected second secondary bellows chambers.

9. The protective helmet of claim 8 wherein said first secondary base section of said first secondary bellows unit and said second secondary base section of said second secondary bellows unit are thermally bonded to said second surface of said inner shell liner.

10. The protective helmet of claim 9 wherein said secondary air transfer conduit is thermally bonded to said second surface of said inner shell liner and defines a secondary air passage having a first end communicating with one of said first secondary bellows chambers and a second end communicating with one of said second secondary bellows chambers to thereby establish a secondary air flow circuit between said first and second secondary bellows units.

11. The protective helmet of claim 1 wherein said inner shell liner includes front and rear mounting flanges for releasably mounting said CAD assembly to said outer shell.

12. The protective helmet of claim 1 wherein said first primary bellows unit is fabricated as a one-piece first primary pad component and said second primary bellows unit is fabricated as a one-piece second primary pad component.

13. The protective helmet of claim 12 wherein said first secondary bellows unit is fabricated as a one-piece first secondary pad component and said second secondary bellows unit is fabricated as a one-piece second secondary pad component.

14. The protective helmet of claim 13 wherein said first primary pad component, said second primary pad component, said first secondary pad component and said second secondary pad component are each molded from a plastic material capable of being thermally bonded to corresponding surfaces of said inner shell liner.

15. A protective helmet to be worn on the head of a person, comprising:

a rigid outer shell defining an interior chamber; and a controlled air dissipation (CAD) assembly removably installed within said interior chamber of said outer shell and including an inner shell liner, first and second primary bellows units mounted to a first surface of said inner shell liner, first and second secondary bellows units mounted to a second surface of said inner shell liner, a primary air transfer conduit and a secondary air transfer conduit, said first primary bellows unit including a first primary bellows chamber, said second primary bellows unit including a second primary bellows chamber, said primary air transfer conduit fluidically interconnecting said first primary bellows chamber with said second primary bellows chamber to facilitate air transfer between said first and second primary bellows units, said first secondary bellows unit including a first secondary bellows chamber, said second secondary bellows unit including a second secondary bellows chamber, said secondary air transfer conduit fluidically interconnecting said first secondary bellows chamber with said second secondary bellows chambers to facilitate air transfer between said first and second secondary bellows units, said inner shell liner including first and second air transfer holes, said first air transfer hole arranged to facilitate air transfer between said first primary bellows chamber and said first secondary bellows chamber, and said second air transfer hole arranged to facilitate air transfer between said second primary bellows chamber and said second secondary bellows chamber.

16. The protective helmet of claim 15 wherein said first primary bellows unit includes a first primary base section adapted to be mounted to said first surface of said inner shell liner, a plurality of first primary pad sections extending from said first primary base section and which each define said first primary bellows chamber therein, and a plurality of first primary bridge sections formed in said first primary base section which fluidically interconnect adjacent first primary pad sections, and wherein said second primary bellows unit includes a second primary base section adapted to be mounted to said first surface of said inner shell liner, a plurality of second primary pad sections extending outwardly from said second primary base section and which each define said second primary bellows chambers therein, and a plurality of second primary bridge sections formed in said second primary base section which fluidically interconnect adjacent second primary pad sections.

17. The protective helmet of claim 16 wherein at least one of said first primary pad sections includes a first primary air charge hole to permit ambient air to communicate with said interconnected first primary bellows chambers, and wherein at least one of said second primary pad sections includes a second primary air charge hole to permit ambient air to communicate with said interconnected second primary bellows chambers.

18. The protective helmet of claim 17 wherein said first primary base section of said first primary bellows unit is thermally bonded to said first surface of said inner shell liner, and wherein said second primary base section of said second primary bellows unit is thermally bonded to said first surface of said inner shell liner.

19. The protective helmet of claim 18 wherein said primary air transfer conduit is thermally bonded to said first surface of said inner shell liner and defines a primary air passage having a first end fluidically communicating with one of said first primary bellows chambers and a second end fluidically communicating with one of said second primary bellows chambers to establish a primary air flow circuit between said first and second primary bellows units.

20. The protective helmet of claim 16 wherein each of said first primary bellows chambers associated with said first primary bellows unit is aligned with a corresponding one of said first secondary bellows chambers associated with said first secondary bellows unit, and wherein said first air transfer hole is formed in said inner shell liner to facilitate air transfer between an aligned set of said first primary and secondary bellows chambers.

21. The protective helmet of claim 16 wherein said first secondary bellows unit includes a first secondary base section adapted to be mounted to said second surface of said inner shell liner, a plurality of first secondary pad sections extending from said first secondary base section and which each define said first secondary bellows chambers therein, and first secondary bridge sections formed in said first secondary base section which fluidically interconnect adjacent first secondary pad sections, and wherein said second secondary bellows unit includes a second secondary base section adapted to be mounted to said second surface of said inner shell liner, a plurality of second secondary pad sections extending outwardly from said second secondary base section and which each define said second secondary bellows chambers therein, and second secondary bridge sections formed in said second secondary base section which fluidically interconnect adjacent second secondary pad sections.

22. The protective helmet of claim 21 wherein at least one of said first secondary pad sections includes a first secondary air charge hole to permit ambient air to communicate with said interconnected first secondary bellows chambers, and wherein at least one of said second secondary pad sections includes a second secondary air charge hole to permit ambient air to communicate with said interconnected second secondary bellows chambers.

23. The protective helmet of claim 22 wherein said first secondary base section of said first secondary bellows unit and said second secondary base section of said second secondary bellows unit are thermally bonded to said second surface of said inner shell liner.

24. The protective helmet of claim 23 wherein said secondary air transfer conduit is thermally bonded to said second surface of said inner shell liner and defines a secondary air passage having a first end communicating with one of said first secondary bellows chambers and a second end communicating with said second secondary bellows chamber to thereby establish a secondary air flow circuit between said first and second secondary bellows units.

25. The protective helmet of claim 15 wherein said first primary bellows unit is fabricated as a one-piece first primary pad component, said second primary bellows unit is fabricated as a one-piece second primary pad component, said first secondary bellows unit is fabricated as a one-piece first secondary pad component, and said second secondary bellows unit is fabricated as a one-piece second secondary pad component.

26. The protective helmet of claim 25 wherein said first primary pad component, said second primary pad component, said first secondary pad component and said secondary pad component are each molded from a plastic material capable of being thermally bonded to corresponding surfaces of said inner shell liner.

27. A controlled air dissipation (CAD) assembly for installation within an interior chamber of a protective helmet, the CAD assembly comprising:

an inner liner including an air transfer hole;

a primary bellows unit mounted to a first surface of said inner liner and including first and second primary bellows chambers which are fluidically interconnected by a primary air channel to facilitate air transfer therebetween, and a primary air charge hole to permit ambient air to communicate with said interconnected first and second primary bellows chambers; and a secondary bellows unit mounted to a second surface of said inner liner and including first and second secondary bellows chambers which are fluidically interconnected by a secondary air channel to facilitate air transfer therebetween, and a secondary air charge hole to permit ambient air to communicate with said interconnected first and second secondary bellows chambers;

wherein said air transfer hole is arranged to facilitate air transfer between said first primary bellows chamber and said first secondary bellows chamber.

28. The CAD assembly of claim 27 wherein said primary bellows unit includes a primary base section configured to be mounted in an air-tight manner to said first surface of said inner liner, first and second primary pad sections extending from said primary base section and respectively defining said first and second primary bellows chamber therein, and a primary bridge section interconnecting said first and second primary pad sections and which defines said primary air channel therein, and wherein said secondary bellows unit includes a secondary base section configured to be mounted in an air-tight manner to said second surface of said inner liner, first and second secondary pad sections extending from said secondary base section and respectively defining said first and second secondary bellows chambers therein, and a secondary bridge section interconnecting said first and second secondary pad sections and defining said secondary air channel therein.

* * * * *